US009622935B2

(12) United States Patent
Fukuyama et al.

(10) Patent No.: US 9,622,935 B2
(45) Date of Patent: Apr. 18, 2017

(54) MASSAGE MACHINE

(71) Applicant: Family Inada Co., Ltd., Osaka (JP)

(72) Inventors: Yoshifumi Fukuyama, Tottori (JP); Nobuhide Kimura, Tottori (JP)

(73) Assignee: FAMILY INADA CO., LTD., Osaka (JP)

( * ) Notice: Subject to any disclaimer, the term of this patent is extended or adjusted under 35 U.S.C. 154(b) by 379 days.

(21) Appl. No.: 14/256,601

(22) Filed: Apr. 18, 2014

(65) Prior Publication Data

US 2014/0343467 A1 Nov. 20, 2014

(30) Foreign Application Priority Data

Apr. 18, 2013 (JP) ..... 2013-087167

(51) Int. Cl.

| | |
|---|---|
| ***A61H 1/00*** | (2006.01) |
| ***A61H 7/00*** | (2006.01) |
| ***A61H 9/00*** | (2006.01) |
| ***A61H 23/00*** | (2006.01) |
| *A61H 15/00* | (2006.01) |

(52) U.S. Cl.

CPC ..... *A61H 7/007* (2013.01); *A61H 9/0078* (2013.01); *A61H 23/006* (2013.01); *A61H 2015/0014* (2013.01); *A61H 2201/0149* (2013.01); *A61H 2201/1215* (2013.01); *A61H 2201/1238* (2013.01); *A61H 2201/1614* (2013.01); *A61H 2201/1623* (2013.01); *A61H 2201/1669* (2013.01); *A61H 2201/1671* (2013.01); *A61H 2201/1676* (2013.01); *A61H 2201/5066* (2013.01); *A61H 2205/062* (2013.01);

(Continued)

(58) Field of Classification Search

CPC .... A61H 7/007; A61H 9/0078; A61H 23/006; A61H 2205/106; A61H 2201/1623; A61H 2201/1614; A61H 2205/108; A61H 2205/062; A61H 2201/1215; A61H 2201/1238; A61H 2201/1676; A61H 2201/1669

See application file for complete search history.

(56) References Cited

U.S. PATENT DOCUMENTS

| | | | | |
|---|---|---|---|---|
| 5,755,677 A * | 5/1998 | Masuda | ..... | A61H 15/0078 601/102 |
| 6,056,707 A * | 5/2000 | Hayashi | ..... | A47C 3/02 601/100 |
| 2012/0215143 A1* | 8/2012 | Inada | ..... | A61H 1/003 601/112 |

FOREIGN PATENT DOCUMENTS

| | | |
|---|---|---|
| JP | 2004-283266 A | 10/2004 |
| JP | 2012-091009 A | 5/2012 |

* cited by examiner

*Primary Examiner* — Quang D Thanh

(74) *Attorney, Agent, or Firm* — Michael Best & Friedrich LLP

(57) ABSTRACT

The massage machine includes a chair main body that includes: a seat part on which a person to be treated is seated, a backrest part, which is provided at a back part of the seat part, and on which the person to be treated leans, and a footrest which is provided at a front part of the seat part and supports leg parts of the person to be treated; guide rails and which are provided at the chair main body; and a first massage part and a second massage part which are configured to respectively move in the height direction along the guide rails. The first massage part moves at least from a position corresponding to the backrest part to a position corresponding to the seat part, and the second massage part (Continued)

moves at least from a position corresponding to the footrest to the position corresponding to the seat part.

10 Claims, 31 Drawing Sheets

(52) U.S. Cl.
CPC .. *A61H 2205/081* (2013.01); *A61H 2205/106* (2013.01); *A61H 2205/108* (2013.01)

FIG.28

| | LEFT: ADVANCING AMOUNT | RIGHT: ADVANCING AMOUNT |
|---|---|---|
| DETECTION POSITION A | 9 | 9 |
| DETECTION POSITION B | 3 | 1 |
| DETECTION POSITION C | 6 | 4 |
| DETECTION POSITION D | 6 | 5 |
| DETECTION POSITION E | 8 | 8 |
| DETECTION POSITION F | 5 | 5 |
| DETECTION POSITION G | 4 | 2 |

FIG.29

| | LEFT: ADVANCING AMOUNT | RIGHT: ADVANCING AMOUNT | BODY: PART DETERMINATION |
|---|---|---|---|
| DETECTION POSITION A | 9 | 9 | UPPER: PART OF SHOULDER |
| DETECTION POSITION B | 3 | 3 | SHOULDER |
| DETECTION POSITION C | 6 | 6 | LOWER: PART OF SHOULDER |
| DETECTION POSITION D | 6 | 6 | UPPER: PART OF LOWER BACK |
| DETECTION POSITION E | 8 | 8 | INTERMEDIATE: PART OF LOWER BACK |
| DETECTION POSITION F | 5 | 5 | LOWER: PART OF LOWER BACK |
| DETECTION POSITION G | 4 | 4 | HIP PART |

FIG.30A

| | LEFT: ADVANCING AMOUNT | RIGHT: ADVANCING AMOUNT | DIFFERENCE |
|---|---|---|---|
| DETECTION POSITION A | 9 | 9 | 0 |
| DETECTION POSITION B | 3 | 1 | 2 |
| DETECTION POSITION C | 6 | 4 | 2 |
| DETECTION POSITION D | 6 | 5 | 1 |
| DETECTION POSITION E | 8 | 8 | 0 |
| DETECTION POSITION F | 5 | 5 | 0 |
| DETECTION POSITION G | 4 | 2 | 2 |

FIG.30B

| | LEFT: ADVANCING AMOUNT (PRESSURIZING FORCE) | LEFT: ADVANCING AMOUNT (PRESSURIZING FORCE) |
|---|---|---|
| DETECTION POSITION A | 9 | 9 |
| DETECTION POSITION B | 3 | 2 |
| DETECTION POSITION C | 6 | 5 |
| DETECTION POSITION D | 6 | 6 |
| DETECTION POSITION E | 8 | 8 |
| DETECTION POSITION F | 5 | 5 |
| DETECTION POSITION G | 4 | 3 |

FIG.31

| | LEFT: ADVANCING AMOUNT | RIGHT: ADVANCING AMOUNT | DIFFERENCE | LOCATION TO BE TREATED |
|---|---|---|---|---|
| DETECTION POSITION A | 9 | 9 | 0 | - |
| DETECTION POSITION B | 3 | 1 | 2 | ⊠ |
| DETECTION POSITION C | 6 | 4 | 2 | ⊠ |
| DETECTION POSITION D | 6 | 5 | 1 | - |
| DETECTION POSITION E | 8 | 8 | 0 | - |
| DETECTION POSITION F | 5 | 5 | 0 | - |
| DETECTION POSITION G | 4 | 2 | 2 | ⊠ |

MASSAGE MACHINE

CROSS-REFERENCES TO RELATED APPLICATION

This application claims the benefit of Japanese Patent Application No. 2013-087167, filed Apr. 18, 2013, the contents of which, including the specification, claims and drawings, are incorporated herein by reference in their entirety.

TECHNICAL FIELD

The present invention relates to a massage part. More specifically, the present invention relates to a massage machine capable of simultaneously massaging different body parts in a height direction and thoroughly massaging body parts from a trunk part to the lower body.

RELATED ART

In the related art, a massage machine with a long guide rail provided so as to extend from a backrest part to a foot placement part has been known (see Japanese Unexamined Patent Application Publication No. 2004-283266, for example). The massage device includes a single treatment machine provided so as to be movable along the long guide rail.

A massage machine, which includes a seat part, a backrest part provided at the seat part so as to be freely reclined, and a foot placing part provided at the seat part so as to be freely rotated, in which a seat part guide rail and a foot placing part guide rail are engaged to each other when an angle between the seat part and the foot placing part is equal to or more than a predetermined value and the seat part guide rail and a backrest part guide rail are engaged to each other when an angle between the seat part and the backrest part is equal to or more than a predetermined value, has been known (see Japanese Unexamined Patent Application Publication No. 2012-091009, for example). The massage machine is provided with two identical roller parts which can move from the backrest part to the foot placing part only when the backrest part and the foot placing part are positioned at predetermined angles with respect to the seat part. The massage machine disclosed in Japanese Unexamined Patent Application Publication No. 2012-091009 is provided with two roller parts, it is possible to simultaneously massage different body parts in the height direction.

The massage machine disclosed in Japanese Unexamined Patent Application Publication No. 2012-091009 is configured such that both the two roller parts are movable within the range from the backrest part to the foot placing part (movable ranges of the two rollers are the same).

SUMMARY OF THE INVENTION

According to the present invention, there is provided a chair type massage machine including: a chair main body which includes a seat part on which a person to be treated is seated, a backrest part, which is provided at a back part of the seat part, and on which the person to be treated leans, and a footrest which is provided at a front part of the seat part and supports leg parts of the person to be treated; guide rails which are provided at the chair main body; and a first massage part and a second massage part which are able to respectively move in a height direction along the guide rails, in which the guide rails include a first movement region which is provided so as to successively extend at least from a position corresponding to the backrest part to a position corresponding to the seat part via a curved part, and a second movement region which is provided so as to successively extend at least from a position corresponding to the footrest to the position corresponding to the seat part via a curved part, in which the first massage part includes a first elevation mechanism and is able to move in the first movement region or from the first movement region to the second movement region by being driven by the first elevation mechanism, and in which the second massage part includes a second elevation mechanism and is able to move in the second movement region or from the first movement region to the second movement region by being driven by the second elevation mechanism.

In addition, since the first movement region is provided so as to successively extend at least from the position corresponding to the backrest part to the position corresponding to the seat part via the curved part and the second movement region is provided so as to successively extend at least from the position corresponding to the footrest to the position corresponding to the seat part via the curved part, it is possible to sufficiently massage a boundary between a lower back part and a hip part and a boundary between thigh parts and calves and thoroughly massage body parts from the trunk part to the lower body.

The first movement region in which the first massage part moves may be a range from the backrest part to a mid-way part of the seat part, and that the second movement region in which the second massage part moves be a range from the footrest to the midway part of the seat part. With such a configuration, movable ranges of the first massage part and the second massage part may be overlapped.

The guide rails may be further provided with a collision preventing region, and that the chair type massage machine may include collision preventing means for preventing the first massage part and the second massage part from colliding with each other in the collision preventing region.

The guide rails may include limit sensors which detect a position corresponding to a lower limit of the first massage part and a position corresponding to an upper limit of the second massage part.

The chair type massage machine may further include a control part, and that the control part may stop movement of the second massage part or may move the second massage part in a direction away from the first massage part when the control part detects a signal for the position corresponding to the lower limit of the first massage part, and may stop movement of the first massage part or may move the first massage part in a direction away from the second massage part when the control part detects a signal for the position corresponding to the upper limit of the second massage part.

The chair type massage machine may further include a base which supports the chair main body, and that the chair main body may be able to swing relative to the base.

The first massage part and the second massage part may have different structures. The first massage part may have a structure which is at least suitable for massaging an upper body, and the second massage part may have a structure which is at least suitable for massaging a lower body.

The first massage part may include a pair of treatment elements and may be configured to be able to perform kneading massage on a trunk part of the person to be treated by causing the treatment elements to move close to and away from each other. The second massage part may include a pair of treatment parts and may be configured to be able to massage outer surfaces of leg parts of the person to be treated with the treatment parts.

The chair type massage machine may further include posture changing means. The posture changing means may include a posture changing body and posture change affected bodies. The posture changing body may be provided at the chair main body The posture change affected bodies may be provided at the first massage part and the second massage part. The posture changing means may change postures of the first massage part and the second massage part.

The first massage part may be able to cause the pair of treatment elements to advance toward or retreat from the person to be treated. The second massage part may be able to cause the pair of treatment parts to advance toward or retreat from the person to be treated.

BRIEF DESCRIPTION OF THE DRAWINGS

FIG. 24A is a diagram showing a state where the first massage part is positioned in the vicinity of the hip part. FIG. 24B is a diagram showing a state where the first massage part causes the right treatment element to advance. FIG. 24C is a diagram showing a state where the first massage part causes the right treatment element to advance and rises from the hip part to the vicinities of the shoulders.

FIG. 28 is a diagram showing an advancing amount of the first massage part according to the embodiment of the present invention.

FIG. 29 is a diagram showing an advancing amount of the first massage part according to the embodiment of the present invention.

FIGS. 30A and 30B both show a diagram with an advancing amount of the first massage part according to the embodiment of the present invention. FIG. 30A is a diagram showing the detected advancing amount of the left treatment element 81, the advancing amount of the right treatment element 81, and the difference thereof. FIG. 30B is a diagram showing pressurizing force set based on the difference.

FIG. 31 is a diagram showing an advancing amount of the first massage part according to the embodiment of the present invention.

DETAILED DESCRIPTION OF THE INVENTION

Hereinafter, a description will be given of embodiments of the present invention with reference to drawings.

Figure 1:
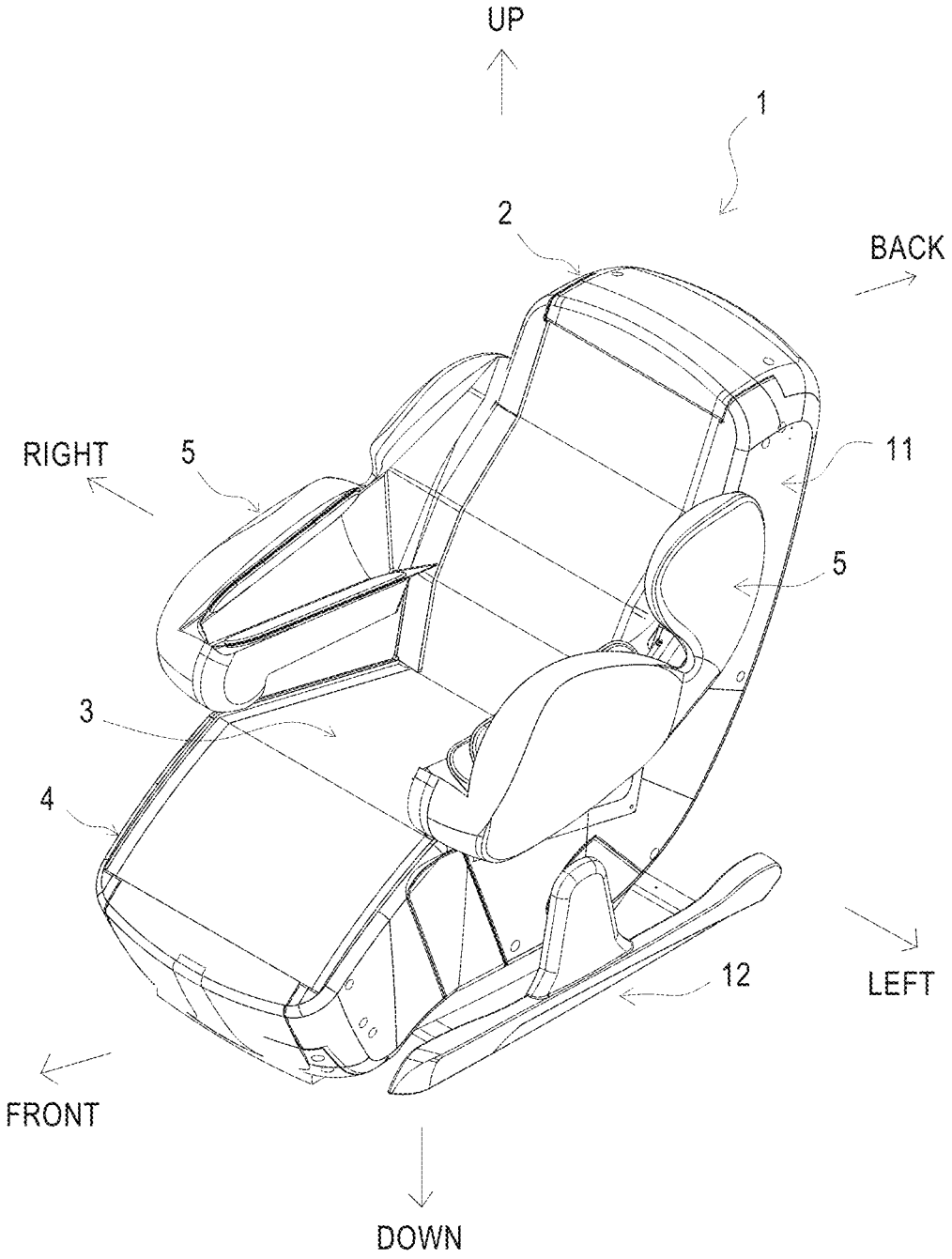
FIG. 1 is a perspective view showing a chair type massage machine according to an embodiment of the present invention.
Figure 2:
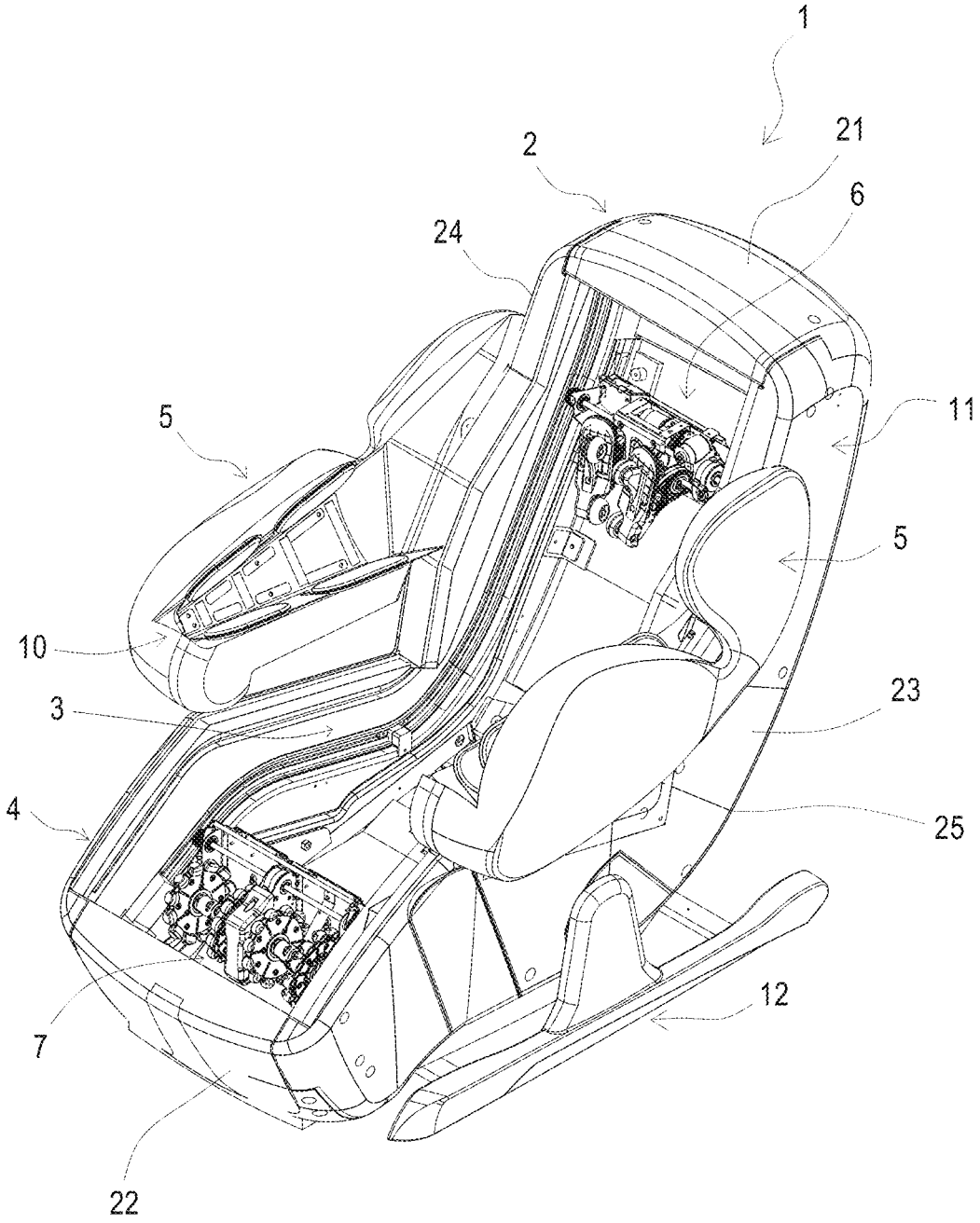
FIG. 2 is a perspective view showing the chair type massage machine according to the embodiment of the present invention.
Figure 3:
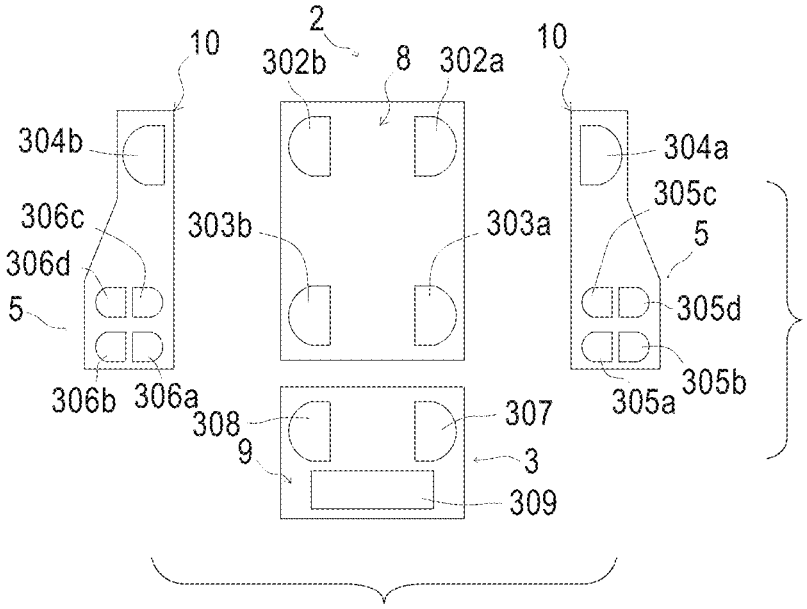
FIG. 3 is a diagram showing arrangement of an air treatment part of the chair type massage machine according to the embodiment of the present invention.
Figure 4:
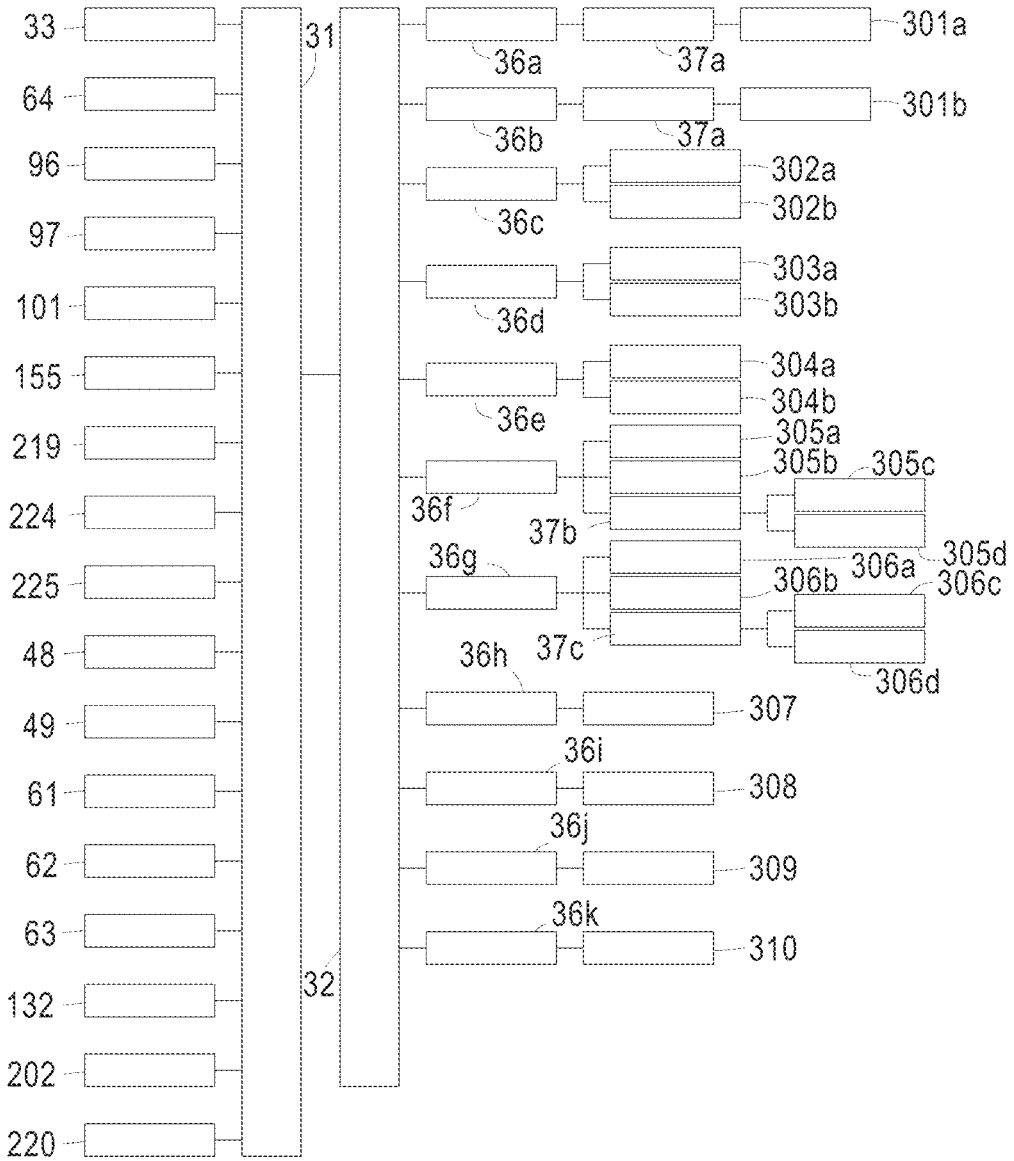
FIG. 4 is a block diagram according to the embodiment of the present invention.

A chair type massage machine 1 in FIG. 1 is shown in a perspective view according to an embodiment of the present invention. In addition, a concept of directions used in the following description coincides with a concept of directions when viewed from a person to be treated who is seated on the massage machine 1 in a standing state, a left hand side is referred to as "left", a right hand side is referred to as "right", a head part side is referred to as "up", a lower back part side is referred to as "down", and other cases will be appropriately described. The chair type massage machine 1 in FIG. 1 includes a backrest part 2 which supports a back of the person to be treated, a seat part 3 on which the person to be treated is seated, and a footrest 4 which supports calves and feet. The chair type massage machine 1 in FIG. 2 is shown in a diagram in which a first massage part 6 and a second massage part 7 included in the chair type massage machine 1 in FIG. 1 are exposed. The chair type massage machine 1 in FIG. 3 is shown in a diagram in which the chair type massage machine 1 according to the embodiment of the present invention is simplified and arrangement of an air treatment part is shown. The chair type massage machine 1 in FIG. 4 is shown in a block diagram of the chair type massage machine 1 according to the embodiment of the present invention.

As shown in FIG. 1, the chair type massage machine 1 according to the present invention mainly includes a chair main body 11 configured of the seat part 3 on which the person to be treated is seated, the backrest part 2, which is integrally provided at a back part of the seat part 3, and on which the user leans, the footrest 4 which is integrally provided at a front part of the seat part 3 and supports leg parts of the user, and armrest parts 5 provided on both side surfaces of the seat part 3, a base 12 which supports the chair main body 11 such that the chair main body 11 can swing in a front-back direction and is installed on a floor surface, a swing mechanism part 13 (see FIG. 21) which causes the chair main body 11 to swing in the front-back direction with respect to the base 12, the first massage part 6, the second massage part 7, a third massage part 8, a fourth massage part 9, and a fifth massage part 10 which are provided at the chair main body 11 and massage treated part of the user.

As shown in FIG. 2, the chair main body 11 is formed of an upper panel 21, a lower panel 22, a left side surface panel 23, a right side surface panel 24, and a back surface panel 25 and is formed into a chair shape with an opening part provided in the front surface by assembling the upper panel 21, the lower panel 22, the left side surface panel 23, the right side surface panel 24, and the back surface panel 25. At the assembled chair main body 11, the seat part 3 on which the person to be treated is seated, the backrest part 2, which is provided at the back part of the seat part 3, and on which the person to be treated leans, and the footrest 4 which is provided at the front part of the seat part 3 and supports the leg parts of the person to be treated are formed. In addition, each of the left side surface panel 23 and the right side surface panel 24 of the chair main body 11 is provided with guide rails 151 which will be described later. The first massage part 6 and the second massage part 7 are respectively movable in the height direction along the guide rails 151 which will be described later.

Figure 14:
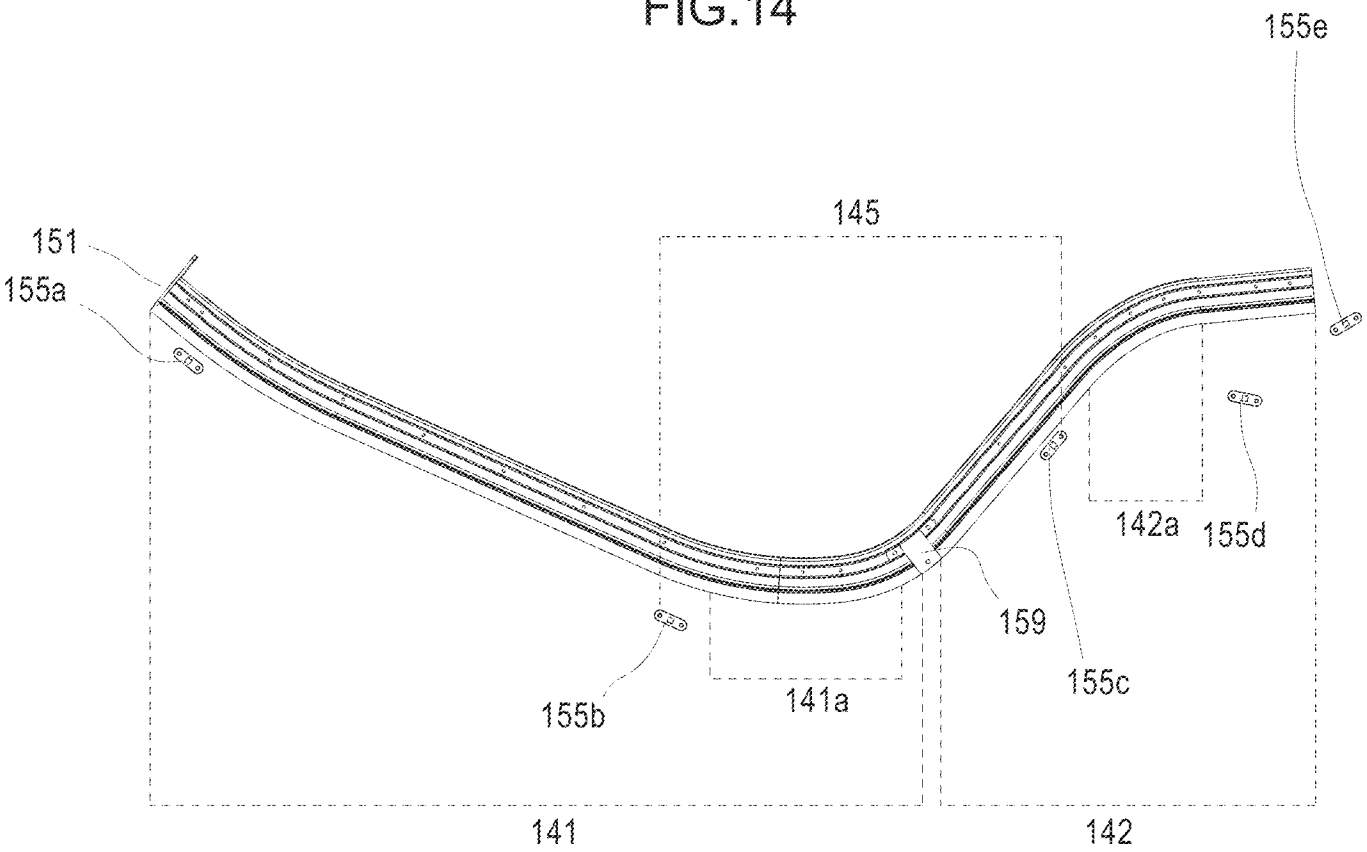
FIG. 14 is a diagram showing the first guide rail of the chair type massage machine according to the embodiment of the present invention.

As shown in FIG. 14, the guide rails 151 which will be described later are successively provided so as to extend at least from a position corresponding to the backrest part 2 to a position corresponding to the seat part 3 via a curved part 141*a* and are successively provided so as to extend at least from a position corresponding to the footrest 4 to the position corresponding to the seat part 3 via a curved part 142*a*. The first massage part 6 includes a first elevation mechanism 65 and can move on the guide rails 151 which will be described later by being driven by the first elevation mechanism 65, and the second massage part 7 includes a second elevation mechanism 204 and can move on the guide rails 151 which will be described later by being driven by the second elevation mechanism 204. In addition, it is preferable to configure the first massage part 6 and the second massage part 7 so as to be easily replaced and maintained such that the first massage part 6 can be attached or detached by removing the upper panel 21 from the chair main body 11 and the second massage part 7 can be attached and detached by removing the lower panel 22 of the chair main body 11.

Figure 5:
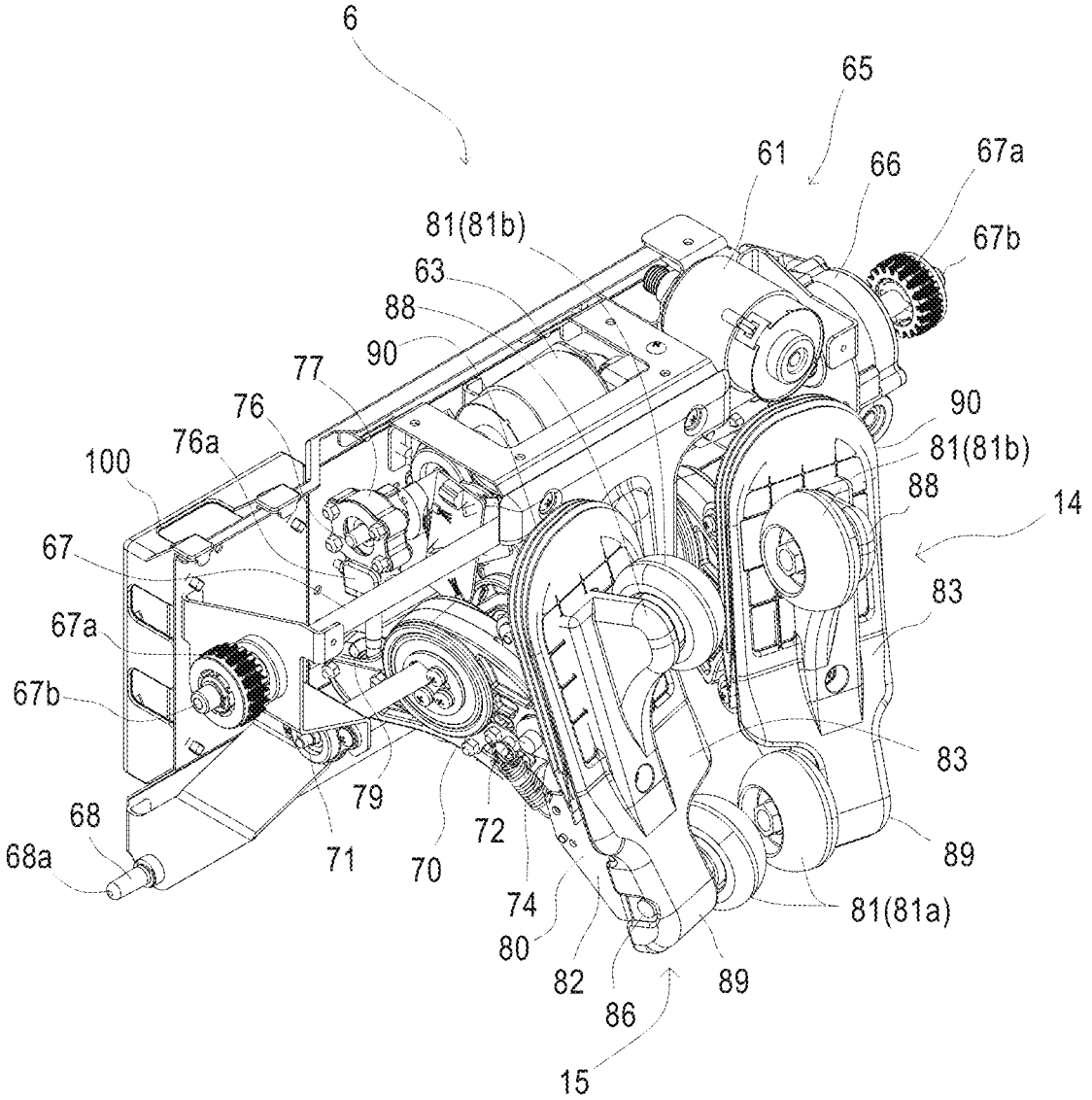
FIG. 5 is a diagram showing a first massage part according to the embodiment of the present invention.
Figure 6:
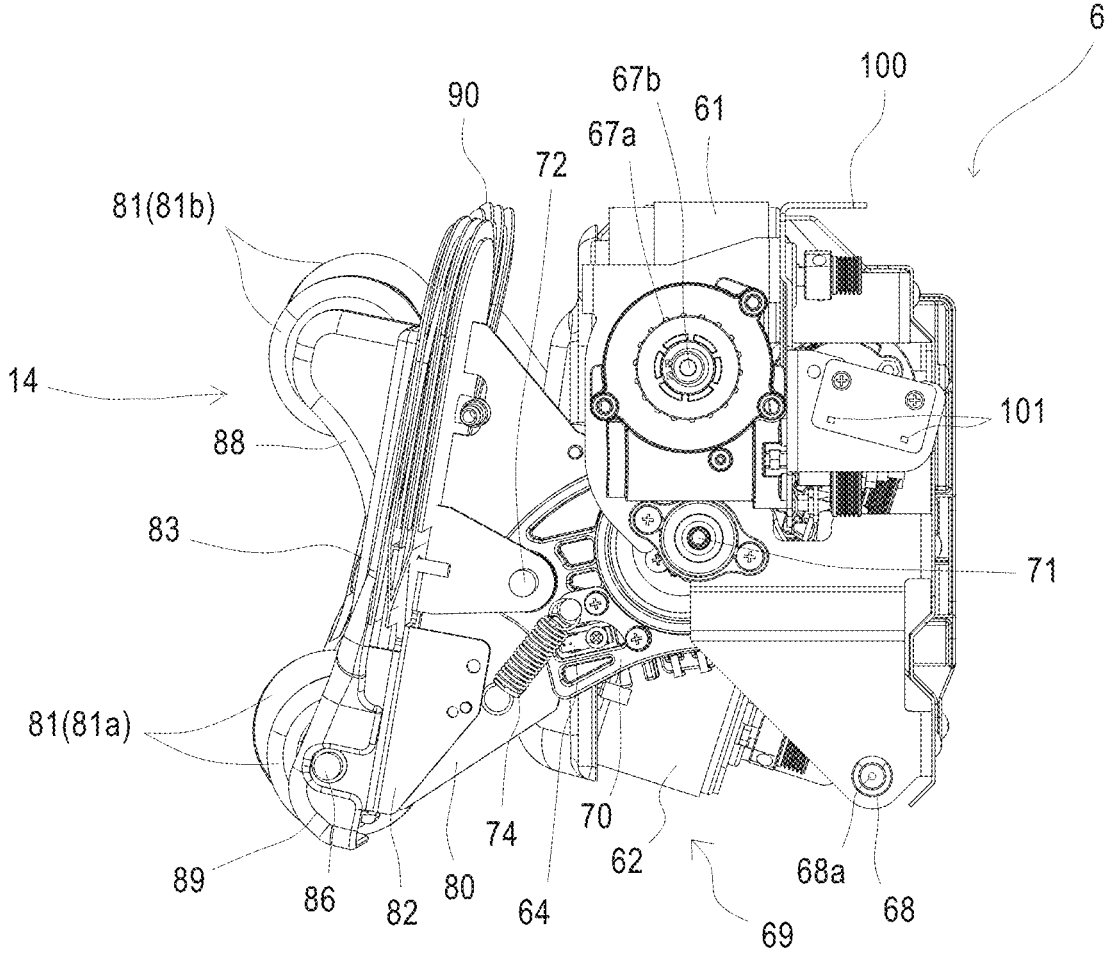
FIG. 6 is a diagram showing the first massage part according to the embodiment of the present invention.

FIGS. 5 and 6 are diagrams showing the first massage part 6. The first massage part 6 includes a left massage unit 14 and a right massage unit 15, drive sources 62 and 63 which cause the first massage part 6 to perform a massage operation, and a frame body 100 which accommodates the drive sources 62 and 63. Each of the left massage unit 14 and the right massage unit 15 includes a second arm 80 provided with a treatment element 81 and a first arm 70 which delivers a massage operation to the second arm 80.

In the frame body 100 of the first massage part 6, the drive source 62 which performs a kneading operation, the drive source 63 which performs a tapping operation, a deceleration mechanism (not shown) which decelerates drive force from the drive sources 62 and 63, a kneading shaft 71 which is connected to the deceleration mechanism (not shown) and performs the kneading operation, and a tapping shaft 76 which performs the tapping operation are provided. The kneading shaft 71 includes a variation angle part (not shown) which is bent at a predetermined angle in the middle of the shaft, the first arm 70 which will be described later is provided at the variation angle part (not shown), and a substantially circular kneading massage operation is delivered to the first arm 70 which will be described later and which is provided at the variation angle part (not shown) by rotating the kneading shaft 71.

In addition, the drive source 62 which performs the kneading operation, the deceleration mechanism (not shown) which decelerates the drive force from the drive source 62, the kneading shaft 71 which is connected to the deceleration mechanism (not shown) and performs the kneading operation, and the variation angle part (not shown) which is bent at a predetermined angle in the middle of the kneading shaft 71 configure a width changing mechanism 69 which changes an interval between a pair of right and left treatment elements 81. With such a configuration, the first massage part 6 can cause the pair of right and left treatment elements 81 to perform the kneading massage on the trunk part and the like of the person to be treated by causing the pair of treatment elements 81 to move closer to and away from one another.

The tapping shaft 76 includes a crank part (not shown) which is eccentrically provided in the middle of the shaft, the crank part (not shown) is provided with a crank rod 76*a* which is coupled to the first arm 70 which will be described later, and a substantially circular tapping massage operation is delivered by the crank rod 76*a* provided at the crank part (not shown) to the first arm 70 by rotating the tapping shaft 76.

The first arm 70 and the second arm 80 are provided on each of the right and left sides, and the second arm 80 includes treatment elements 81 (81*a* and 81*b*). In addition, since the first arms 70 and the second arms 80 on the right and left sides have the same configuration, the following description thereof will be given with reference to the first arm 70 and the second arm 80 on the left side.

Figure 7A:
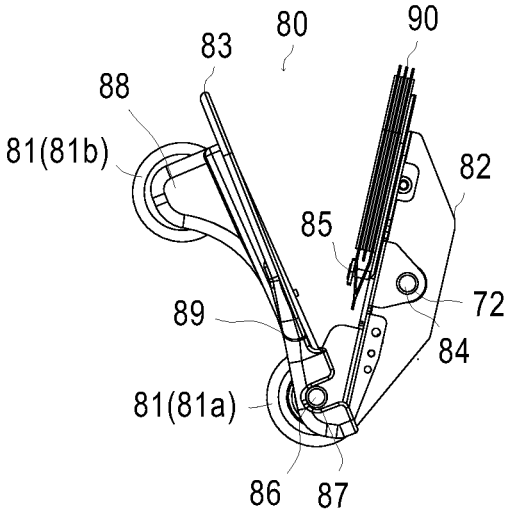
FIG. 7A is a diagram showing the second arm in the first massage part according to the embodiment of the present invention.
Figure 7B:
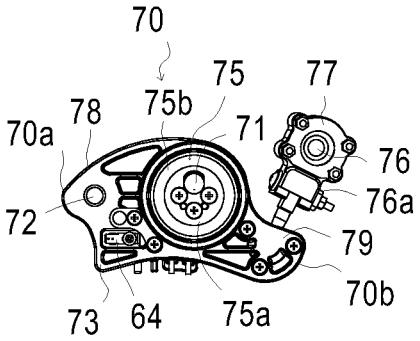
FIG. 7B is a diagram showing the first arm in the first massage part according to the embodiment of the present invention.
Figure 7C:
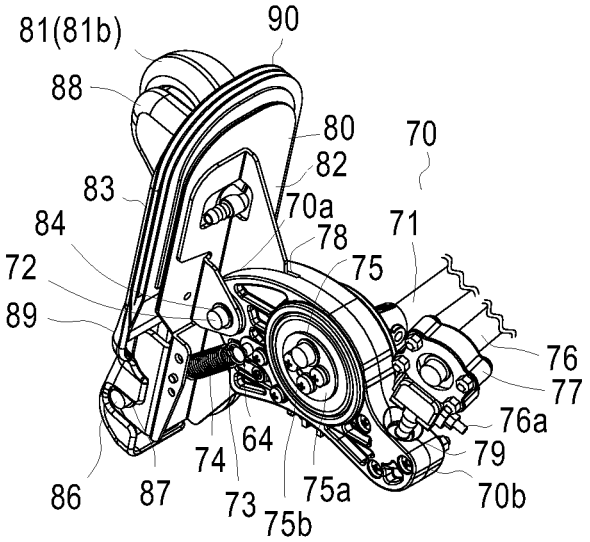
FIG. 7C is a diagram of a state in which the first arm and the second arm in the first massage part are combined.
Figure 8A:
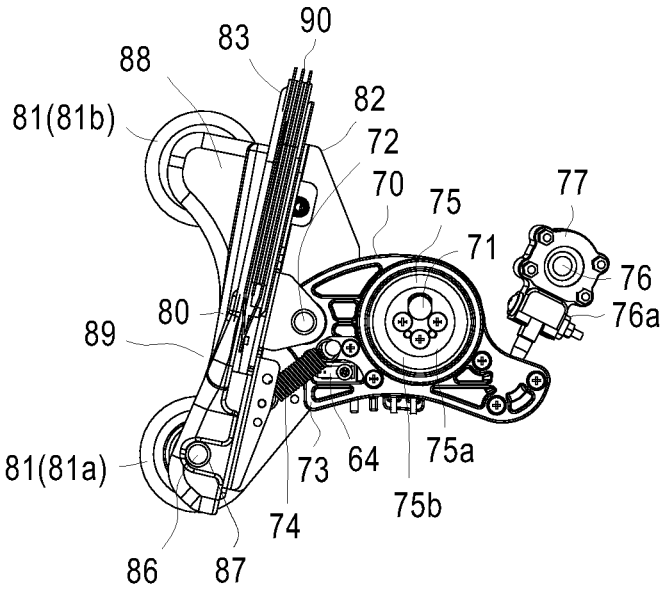
FIG. 8A is a diagram showing the first massage part according to the embodiment of the present invention, specifically a state in which the advancing and retreating mechanism provided at the second arm of the first massage part is not operated.
Figure 8B:
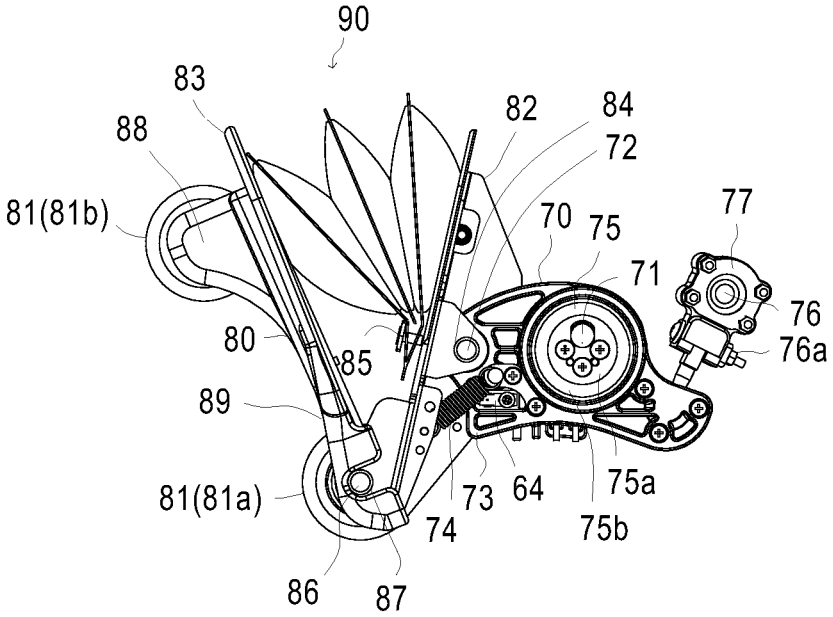
FIG. 8B is a diagram showing the first massage part according to the embodiment of the present invention, specifically a state in which the advancing and retreating mechanism provided at the second arm of the first massage part is operated.

FIGS. 7 and 8 are diagrams showing the first arm 70 and the second arm 80 of the first massage part 6 according to the embodiment of the present invention. FIG. 7A is a diagram showing the second arm 80. FIG. 7B is a diagram showing the first arm 70. FIG. 7*c* is a diagram of a state in which the first arm 70 and the second arm 80 are combined. FIG. 8 is a diagram showing an advancing and retreating mechanism 90 of the first massage part 6 according to the embodiment of the present invention. FIG. 8A is a diagram showing a state in which the advancing and retreating mechanism 90 provided at the second arm 80 of the first massage part 6 is not operated. FIG. 8B is a diagram showing a state in which the advancing and retreating mechanism 90 provided at the second arm 80 of the first massage part 6 is operated.

The first arm 70 includes a first swing shaft 72 which enables providing the second arm 80 so as to be able to swing, restriction means 73 for restricting swing of the second arm 80, bias means 74 for returning the second arm 80 from the swing, a kneading shaft coupling part 75 which is coupled to and cooperates with the kneading shaft 71, and a tapping shaft coupling part 77 which attaches an end part of the crank rod 76*a* to the tapping shaft 76. In addition, the first arm 70 includes swing detection means (shoulder position detection means) 64 which will be described later, and detects the swing operation of the second arm 80.

A portion of the first arm 70 on the side of the user will be referred to as a front end part 70*a*, and a portion which is positioned furthest from the user will be referred to as a back end part 70*b*. The front end part 70*a* is provided with a slit 78, and the second arm 80 is provided in the gap of the slit 78, and the first swing shaft 72 which penetrates through the slit 78 and the second arm 80 and supports the second arm 80 so as to be able to swing is provided.

In addition, the front end side is provided with the restriction means 73 for restricting the swing of the second arm 80 such that the second arm 80 swings within an appropriate swing range. Moreover, the bias means 74 for returning the second arm 80 from the swinging state is provided and can return the second arm 80 in the swinging state to an original position.

In addition, the swing detection means (shoulder position detection means) 64 is provided at the slit 78 such that the swing of the second arm 80 can be detected. An optical sensor is used as the swing detection means (shoulder position detection means) 64, and the swinging state of the second arm 80 is detected based on ON and OFF of the sensor. The swing detection means (shoulder position detection means) 64 is provided so as to face the other swing detection means 64 inside the slit 78 of the first arm 70. The second arm 80 swings in the slit 78 and passes between a light-emitting part and a light-receiving part of the optical sensor, ON and OFF are switched, and the swing of the second arm 80 can be detected. In addition, since the second arm 80 is made to swing along undulations of the body by an elevating operation of a first elevation mechanism 65 which will be described later and the undulations of the body are detected, it is also possible to detect not only the shoulder position but also positions of a hip, a lower back, a back, and the like.

The back end part 70*b* of the first arm 70 is provided with a spherical concave part and a spherical seating 79 to which the end part of the crank rod 76*a* provided at the crank part (not shown) of the tapping shaft 76 is coupled.

The end part of the crank rod 76*a* is spherical, and it is possible to deliver the tapping massage operation from the crank rod 76*a* by engaging the crank rod 76*a* with the spherical seating 79 of the first arm 70. It is possible to cause the second arm 80 provided at the front end part 70*a* to perform the tapping operation with a large motion based on the principle of leverage by coupling the crank rod 76*a* which delivers the tapping massage operation to the spherical seating 79 provided at the back end side of the first arm.

In addition, the kneading shaft coupling part 75 of the first arm 70 is provided between the front end part 70*a* and the back end part 70*b*. The first arm 70 is provided at the variation angle part (not shown) of the kneading shaft 71 and can deliver the kneading massage operation by rotating the kneading shaft 71. The kneading shaft coupling part 75 is configured of an angle variation cam 75*a* and a bearing 75*b*, is coupled to the kneading shaft 71, and can perform the kneading operation.

The second arm 80 is provided at the first arm 70 so as to be able to swing and includes the pair of upper and lower treatment elements 81 (81*a* and 81*b*) and the advancing and retreating mechanism 90. Specifically, the second arm 80 includes a first treatment element support body 82 and a second treatment element support body 83 which are controlled by the advancing and retreating mechanism 90 to advance and retreat with respect to the person to be treated. The first treatment element support body 82 includes a through hole 84 through which the first swing shaft 72 is made to pass, a first attachment part 85 to which the advancing and retreating mechanism 90 is attached, a through hole 87 of the second swing shaft 86, at which the second treatment element support body 83 and the first treatment element 81*a* are concentrically provided. The first treatment element support body 82 is formed by combining flat plate materials, the first attachment part 85 and the through hole 87 of the second swing shaft 86 are provided in the front surface which faces the second treatment element support body 83, and a hole through which piping of the advancing and retreating mechanism 90 is made to pass and the through hole 84 through which the first swing shaft 72 is made to pass are provided in the back surface.

The first attachment part 85 is attached to the front surface of the first treatment element support body 82, and the second treatment element support body 83 and the first treatment element 81*a* are attached by the second swing shaft 86 to positions lower than that of the first attachment part 85.

In addition, the second treatment element support body 83 includes the through hole 87 of the second swing shaft 86 and a second attachment part 88 which is an attachment part of the second treatment element 81*b*. The through hole 87 of the second swing shaft 86 and the second attachment part 88 are provided at the front surface of the second treatment element support body 83, and a surface which receives drive force from the advancing and retreating mechanism 90 is provided at the back surface which faces the front surface of the first treatment element support body 82. In addition, the through hole 87 of the second swing shaft 86 is provided at a lower position in the front surface of the second treatment element support body 83, and the second attachment part 88 is provided at an upper position in the front surface of the second treatment element support body 83. Moreover, the surface which receives the drive force from the advancing and retreating mechanism 90 is positioned at the back surface of the second attachment part 88 so as to easily deliver the drive force to the second treatment element 81*b*.

In addition, the second swing shaft 86 is provided with the bias means (not shown) for returning the second treatment element support body 83 from a state in which the second treatment element support body 83 is made to swing by the advancing and retreating mechanism 90, and the bias means is held at a position along the first treatment element support body 82 in a state in which the advancing and retreating mechanism 90 is not operated. In addition, the second treatment element support body 83 includes a cover part 89, and the cover part 89 is provided at the second treatment element support body 83 and has a size for covering the second treatment element support body 83. Moreover, the cover part 89 is provided in order to prevent interference between the second arm 80 and other members such as a backrest part 2. Since there is a concern that the width of the second arm in the right-left direction increases due to provision of the advancing and retreating mechanism 90, the second arm interferes with the opening of the backrest part 2, and the advancing and retreating mechanism 90 is rubbed and damaged, the damage of the advancing and retreating mechanism 90 is prevented by providing the cover part 89.

In addition, the relative distance between the first treatment element 81*a* and the second treatment element 81*b* is held even when the advancing and retreating mechanism 90 is operated. That is, the lower part of the second treatment element support body 83 is provided on the second swing shaft 86 along with the first treatment element 81*a*, the second treatment element 81*b* is provided at an upper part of the second treatment element support body 83, the advancing and retreating mechanism 90 causes swinging about the second swing shaft 86 of the second treatment element support body 83 as a support point, and therefore, the distance between the first treatment element 81*a* and the second treatment element 81*b* is held. For example, if the distance between the first treatment element 81*a* and the second treatment element 81*b* varies, then the first treatment element 81*a* and the second treatment element 81*b* are brought into a state of being positioned closer, the treatment operation is changed to a grabbing operation, and therefore, it is not possible to adjust strength of the massage operation being performed due to the change in the treatment operation. By holding the distance between the first treatment element 81*a* and the second treatment element 81*b* as described above, it is possible to adjust strength of the same type of massage operation.

The advancing and retreating mechanism 90 is configured of an accordion-shaped air cell 301*a* (301*b*) and is provided at the first attachment part 85 of the first treatment element support body 82. In addition, the first attachment part 85 has a hole through which piping is made to pass, and an air supply and discharge port of the accordion-shaped air cell 301*a* (301*b*) is extracted therefrom. The advancing and retreating mechanism 90 has a swing support point on the side of the first treatment element 81*a* and swings to the side of the person to be treated by supplying air. In addition, it is preferable that the accordion-shaped air cell 301*a* (301*b*) be smaller than air cells (302*a* and the like) for treatment. By reducing the size of the air cell, it is possible to achieve a swelling state with a small amount of air and adjust the strength at a high response speed. In addition, air piping (not shown) which is connected to the air supply and discharge port of the accordion-shaped air cell 301*a* (301*b*) continues to an air supply and discharge device 32 positioned below the seat part 3.

A squeezing 37*a* is arranged in the middle of the air piping and suppresses the amounts of the air which flows in to or flows out from the accordion-shaped air cell 301*a* (301*b*) of the advancing and retreating mechanism 90. Since the accordion-shaped air cell 301*a* (301*b*) of the advancing and retreating mechanism 90 has the size which is smaller than those of the other air cells, the reaction speed is excessively high if the air is drawn in the same manner as in an ordinary air cell, and therefore, the squeezing 37*a* (see FIG. 4) is provided to suppress the flow-in and the flow-out of the air. The squeezing 37*a* (37*b* and 37*c*) is formed of a tube-shaped member connecting piping in order for the squeezing 37*a* to be arranged in the middle of the air piping. In addition, the squeezing 37*a* (37*b* and 37*c*) may be formed into a shape obtained by simply reducing an inner diameter in the middle of the flow path or a shape with a gradually decreasing inner diameter.

If the inner diameter of the squeezing 37*a* (37*b* and 37*c*) when viewed from the side of the advancing and retreating mechanism 90 (the air flow-out side) is formed into a shape obtained by simply reducing the inner diameter and the inner diameter of the squeezing 37*a* (37*b* and 37*c*) when viewed from the side of the air supply and discharge device 32 (air flow-in side) is formed into a shape obtained by gradually reducing the inner diameter toward the advancing and retreating mechanism 90, it is possible to add variation such that the air flows in at a higher speed than that when the air flows out and the air flows out at a lower speed than that when the air flows in. In addition, since the advancing and retreating mechanism 90 is configured of the air cell, it is possible to perform treatment with smaller burden on the person to be treated by a cushioning property of the air cell.

By providing the cushioning property as described above, it is possible to perform treatment on locations for which excessively strong treatment is not suitable. The locations for which excessively strong treatment is not suitable means an edge of a shoulder blade, an edge of a backbone, and the like, and it is necessary to pay attention when vicinities of such bones are treated. In addition, when the treatment elements 81 are made to travel, the weight of the person to be treated is delivered from the treatment elements, and burden is applied to the arm 80 supporting the treatment element 81 and the first massage part 6.

In a case of a massage machine with no cushion body, for example, excessive burden is applied to the massage machine. It is possible to reduce the burden of the advancing and retreating mechanism 90 even when the weight of the person to be treated is applied, by configuring the advancing and retreating mechanism 90 of the air cell as described above. Moreover, the air cell may be provided with a pressure sensor (not shown) and a valve body which discharges a predetermined amount of air to the outside so as to release the air inside the air cell when excessive pressure is applied.

In addition, the first massage part 6 further includes the first elevation mechanism 65 which performs an elevating operation along the first guide rails 151 which will be described later. The first elevation mechanism 65 is installed inside the frame body 100 and includes a drive source 61 for elevation, an elevating operation delivery part 66, a first shaft body 67, and a second shaft body 68. The first shaft body 67 is a shaft which receives drive force of the drive source 61 for elevation from the elevating operation delivery part 66 and performs driving.

Pinions 67*a* which are engaged with racks 152 attached to the pair of first guide rails 151 which will be described later are provided in the vicinities of opposite end parts of the first shaft body 67. In addition, the opposite end parts are provided so as to extend further than the attachment positions of the pinions 67*a* such that extending parts 67*b* of the opposite end parts are positioned in grooves 154 of side wall parts 153 of the first guide rails 151 which will be described later.

With such a configuration, the extending parts 67*b* of the opposite end parts are inserted into the grooves 154, and the first massage part 6 can be elevated only with the rack 152 on one side. Moreover, the opposite end parts 68*a* of the second shaft body 68 are held in grooves 172 of a pair of second guide rails 171 which will be described later and are operated to follow bending of the second guide rails 171 which will be described later.

Since the extending parts 67*b* of the first shaft body 67 are positioned in the grooves 154 of the first guide rails 151 which will be described later and the end parts 68*a* of the second shaft body 68 are positioned in the grooves 172 of the second guide rails 171 which will be described later, it is possible to prevent the first massage part 6 from falling off.

In addition, the frame body 100 is provided with detection parts 101 (see FIG. 6). The detection parts 101 can control the position of the first massage part 6 by detecting detected parts 155 provided in the vicinity of the first guide rails 151 and the second guide rails 171. Two detection parts 101 are aligned and installed in a moving direction of the first massage part 6 and can detect and control the traveling direction of the first massage part 6 based on which detection part 101 detects the detected parts 155.

Figure 9:
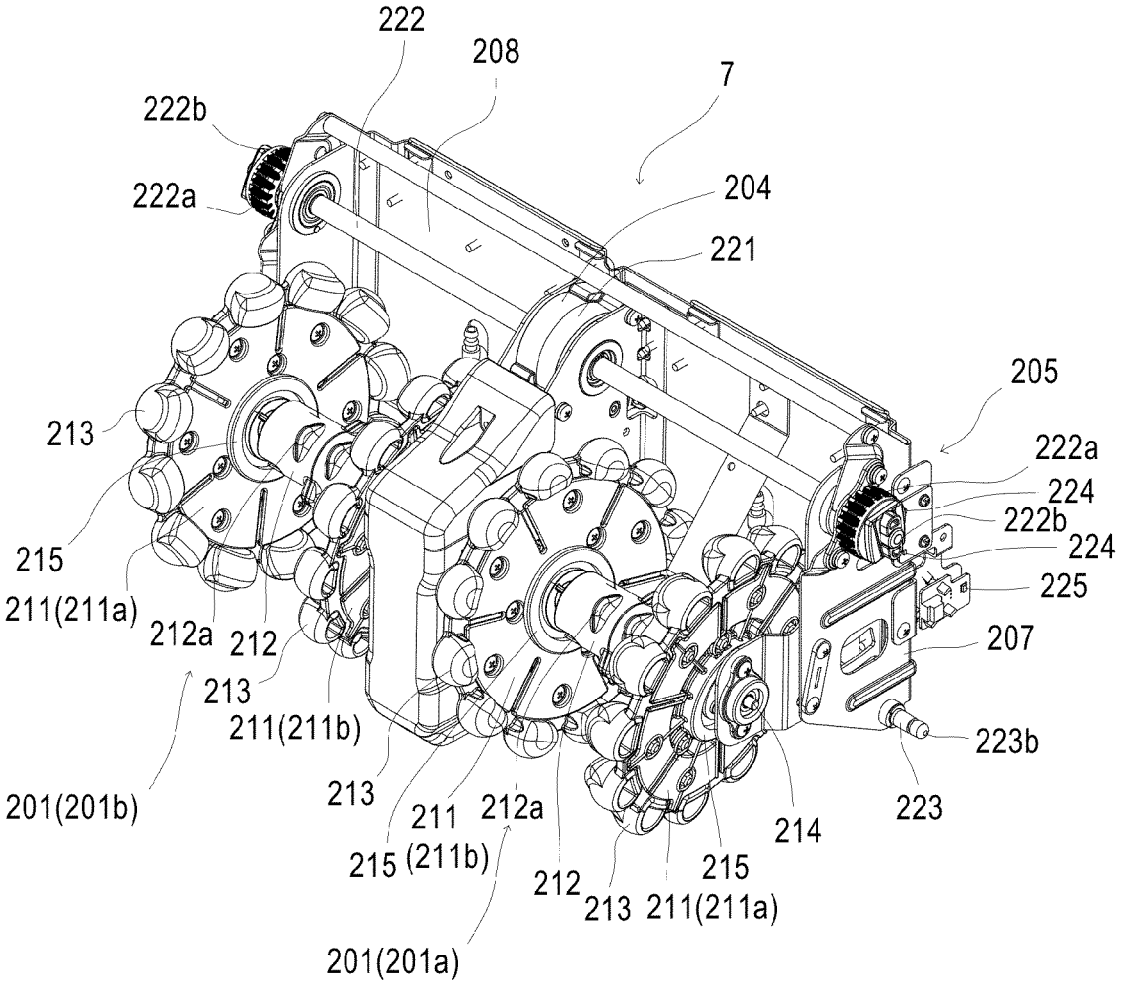
FIG. 9 is a diagram showing a second massage part according to the embodiment of the present invention.
Figure 10:
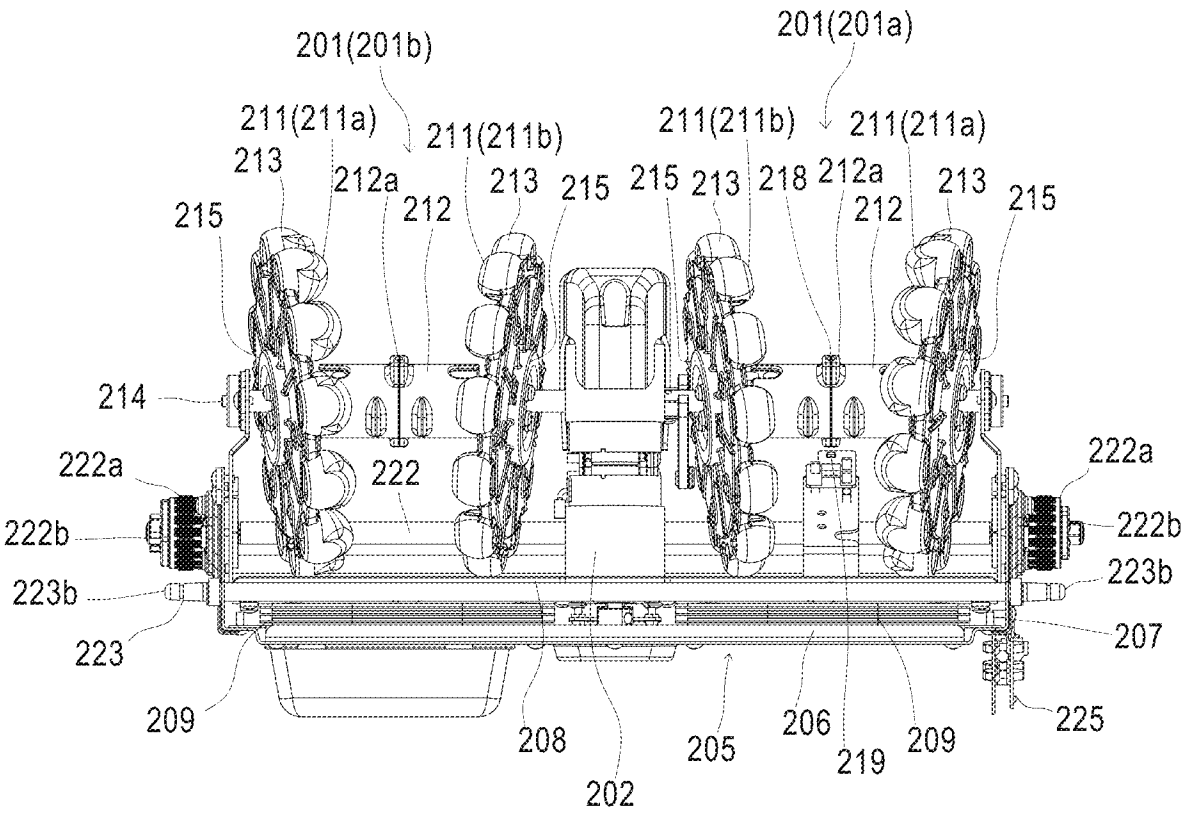
FIG. 10 is a diagram showing the second massage part according to the embodiment of the present invention.

FIGS. 9 and 10 are diagrams showing the second massage part 7. The second massage part 7 includes a pair of right and left treatment parts 201 which can massage outer surfaces of leg parts and the like of the person to be treated. The second massage part 7 includes the pair of right and left treatment parts 201, a drive source 202 which drives the treatment parts 201, a drive delivery mechanism (not shown) which delivers drive force of the drive source 202 to the pair of right and left treatment parts 201, a second elevation mechanism 204 which elevates the second massage part 7, and a frame body 205 which holds the treatment parts 201, the drive source 202, the drive delivery mechanism (not shown), and the second elevation mechanism 204.

The frame body 205 is formed of a bottom plate 206 and a pair of side plates 207 and includes a swing plate 208 and an advancing and retreating mechanism 209. The swing plate 208 is provided at the bottom plate 206 of the frame body 205 so as to be able to swing, and the treatment parts 201, the drive source 202, the drive delivery mechanism (not shown), and the second elevation mechanism 204 are fixed to the swing plate 208. In addition, the swing plate 208 is configured to swing about a first shaft body 222, which will be described later, as a swing shaft, and it is possible to cause the swing plate 208 to swing by the advancing and retreating mechanism 209 provided at the bottom plate 206.

By the advancing and retreating mechanism 209, the pair of right and left treatment parts 201 of the second massage part 7 can advance toward and retreat from the person to be treated. The advancing and retreating mechanism 209 causes the swing plate 208 to advance toward and retreat from the side of the person to be treated by causing an advancing and retreating air cell 310 which will be described later to draw and discharge air.

A left treatment part 201*a* of the pair of right and left treatment parts 201 includes a pair of treatment plates 211 which include an outer treatment plate 211*a*, an inner treatment plate 211*b*, and an intermediate treatment body 212 disposed between the outer treatment plate 211*a* and the inner treatment plate 211*b*, a right treatment part 201*b* also includes, in the same manner as the left treatment part 201*a*, a pair of treatment plates 211 which include an outer treatment plate 211*a*, an inner treatment plate 211*b*, and an intermediate treatment body 212 disposed between the outer treatment plate 211*a* and the inner treatment plate 211*b*. The pair of treatment plates 211 includes a plurality of treatment elements 213, and the treatment elements 213 are provided at edge parts of the treatment plates 211. In addition, the intermediate treatment body 212 includes treatment projections 212*a*.

The pair of right and left treatment parts 201 are provided on a drive shaft 214 which is rotated by drive force received from the drive source 202 via the drive delivery mechanism (not shown), and the drive shaft 214 is provided with a plurality of attachment parts (not shown) to which the pair of right and left treatment parts 201 are attached.

The outer treatment plate 211*a* is fixed to the attachment part (not shown) via an eccentric angle variation cam 215, the inner treatment plate 211*b* is fixed to the attachment part (not shown) via the eccentric angle variation cam 215, and the intermediate treatment body 212 is fixed to the attachment part (not shown) via an eccentric cam (not shown). In addition, the eccentric angle variation cam 215 and the eccentric cam (not shown) respectively include bearing parts.

The outer treatment plate 211*a* is inclined by a predetermined angle by the eccentric angle variation cam 215, the inner treatment plate 211*b* is inclined by a predetermined angle by the eccentric angle variation cam 215, and the predetermined angle of the outer treatment plate 211*a* is in a phase which is different from that of the inner treatment plate 211*b* by 180°. With such a configuration, it is possible to perform an operation of pinching the body of the person to be treated.

In addition, the intermediate treatment body 212 is eccentrically provided and performs an operation while depicting an ellipse locus. With such a configuration, it is possible to perform operations of pressurizing and rubbing the body of the person to be treated.

In addition, magnets 218 are provided inside a part of the plurality of treatment projections 212*a* of the intermediate treatment body 212. The swing plate 208 is provided with a hall IC 219 which is a detection part 219 for detecting the magnets 218 provided in the treatment projections 212*a* of the intermediate treatment body 212. With such a configuration, it is possible to regard positions at which the detection part 219 detects the magnets 218 as the detected parts 218 as stop positions of the pair of right and left treatment parts 201. In addition, the second elevation mechanism 204 can elevate the second massage part 7.

The second elevation mechanism 204 of the second massage part 7 performs the elevating operation along the first guide rails 151 which will be described later. The second elevation mechanism 204 is installed in the frame body 205 and includes a drive source 220 for elevation (see FIG. 4), an elevating operation delivery part 221, the first shaft body 222, and a second shaft body 223. The first shaft body 222 is a shaft which receives drive force of the drive source 220 for elevation from the elevating operation delivery part 221 and performs driving. In the vicinities of the opposite end parts of the first shaft body 222, pinions 222*a* which are engaged with the racks 152 attached to the pair of first guide rails 151 which will be described later are provided. In addition, the opposite end parts include extending parts 222*b* which are provided so as to extend further than the attachment positions of the pinions 222*a*, and the extending parts 222*b* of the opposite end parts are configured to be positioned in the grooves 154 of the side wall parts 153 of the first guide rails 151 which will be described later. With such a configuration, the extending parts 222*b* are inserted into the grooves 154, and the second massage part 7 can be elevated only with the rack 152 on one side.

In addition, opposite end parts 223*b* of the second shaft body 223 are held in grooves 172 of the pair of second guide rails 171 which will be described later and are operated so as to follow bending of the second guide rails 171 which will be described later. As described above, the extending parts 222*b* of the first shaft body 222 are positioned in the grooves 154 of the first guide rails 151 as will be descried later, and the end parts 223*b* of the second shaft body 223 are positioned in the grooves 172 of the second guide rails 171 which will be described later, and therefore, it is possible to prevent the second massage part 7 from falling off.

In addition, the frame body 205 is provided with detection parts 224 and an initial position detection part 225. The detection parts 224 can control the position of the second massage part 7 by detecting the detected parts 155 provided in the vicinities of the first guide rails 151 and the second guide rails 171. The two detection parts 224 are aligned and installed in the moving direction and can detect and control the traveling direction based on which detection part 224 detects the detected part. In addition, the initial position detection part 225 detects detected parts 155*d* which will be described later. The position detected by the initial position detection part 225 is a stop position of the second massage part 7 and a position at which calves are treated.

The backrest part 2 of the chair type massage machine 1 shown in FIG. 3 is provided with a third massage part 8, the third massage part 8 is configured of air treatment parts which are operated by the air supply and discharge device 32 disposed below the seat part 3 which will be described later, a pair of right and left air treatment parts are provided at portions corresponding to shoulders of the person to be treated, and a pair of right and left air treatment parts are provided at portions corresponding to a lower back of the person to be treated. A pair of right and left rear air cell L302*a* and rear air cell R302*b* for the shoulder parts, a pair of right and left lower back air cell L303*a* and lower back air cell R303*b* for the lower back part may have pivot support points on the side of the center in a width direction of the backrest part 2. The backrest part 2 may include a pillow part which supports a head part of the person to be treated. In addition, the pillow part may configure a sixth massage part.

The seat part 3 is provided with a control part 31 which controls massage operations, the air supply and discharge device 32 which supplies and discharges air to and from the air treatment parts arranged at the respective locations, and an operation part 33 which operates motions of the chair type massage machine 1. In addition, a seating surface of the seat part 3 is provided with a fourth massage part 9. The fourth massage part 9 is configured of an air treatment part, includes a seat air cell L307 and a seat air cell R308 capable of pressurizing and pressing upward a hip part of the person to be treated from the right and left sides, and includes a seat air cell A309 which is provided on the side of knees of the person to be treated and pressurizes thigh parts near the knees from the rear side. In addition, the seat part 3 includes a pair of leg frames 12*a* which are fixed by a base 12, arranged with a predetermined distance in the right-left direction, and installed on the floor surface and a plurality of pivot shafts 12*b* to 12*d* with shaft directions in the right-left direction. The back part of the leg frames 12*a* are provided with casters 12*e* which rotates and moves on a floor surface such that the chair type massage machine 1 can be easily moved by lifting the front part of the massage machine 1. The base 12 includes the pivot shaft 12*b* about which the chair main body 11 is pivotably supported by the base 12 and the pivot shaft 12*c* and the pivot shaft 12*d* to which a swing drive part 131 of the swing mechanism part 13 which will be described later for causing the chair main body 11 to swing in a front-back direction.

Figure 11:
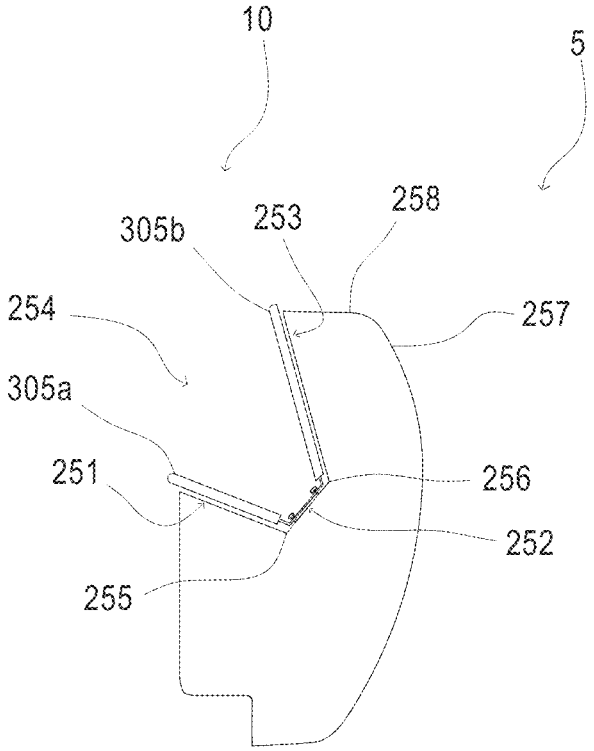
FIG. 11 is a diagram showing an armrest part of the chair type massage machine according to the embodiment of the present invention.
Figure 12B:
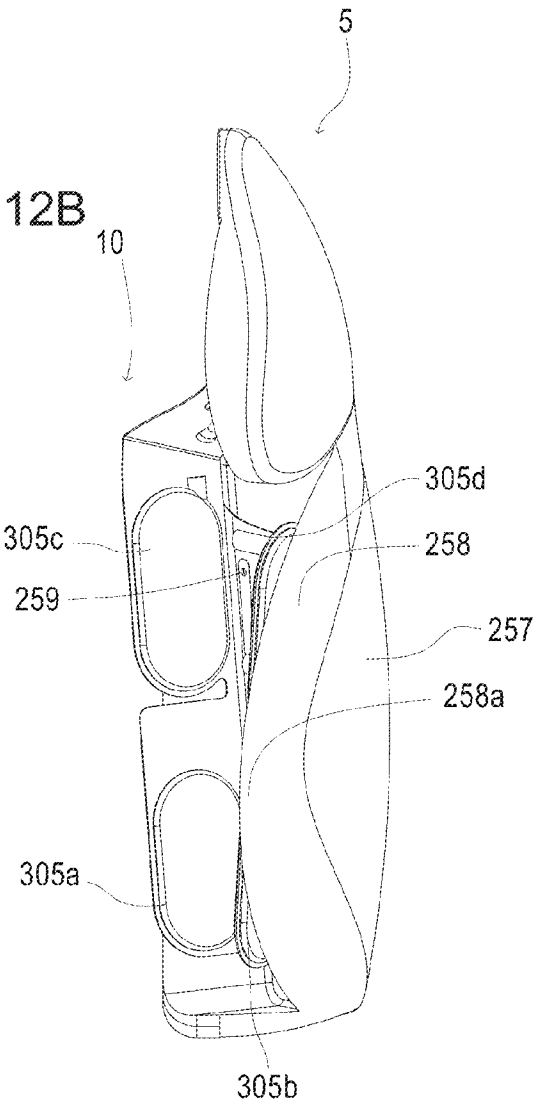
FIG. 12B is a diagram of the armrest part of the chair type massage machine, according to the embodiment of the present invention, when viewed from the upper side.
Figure 12A:
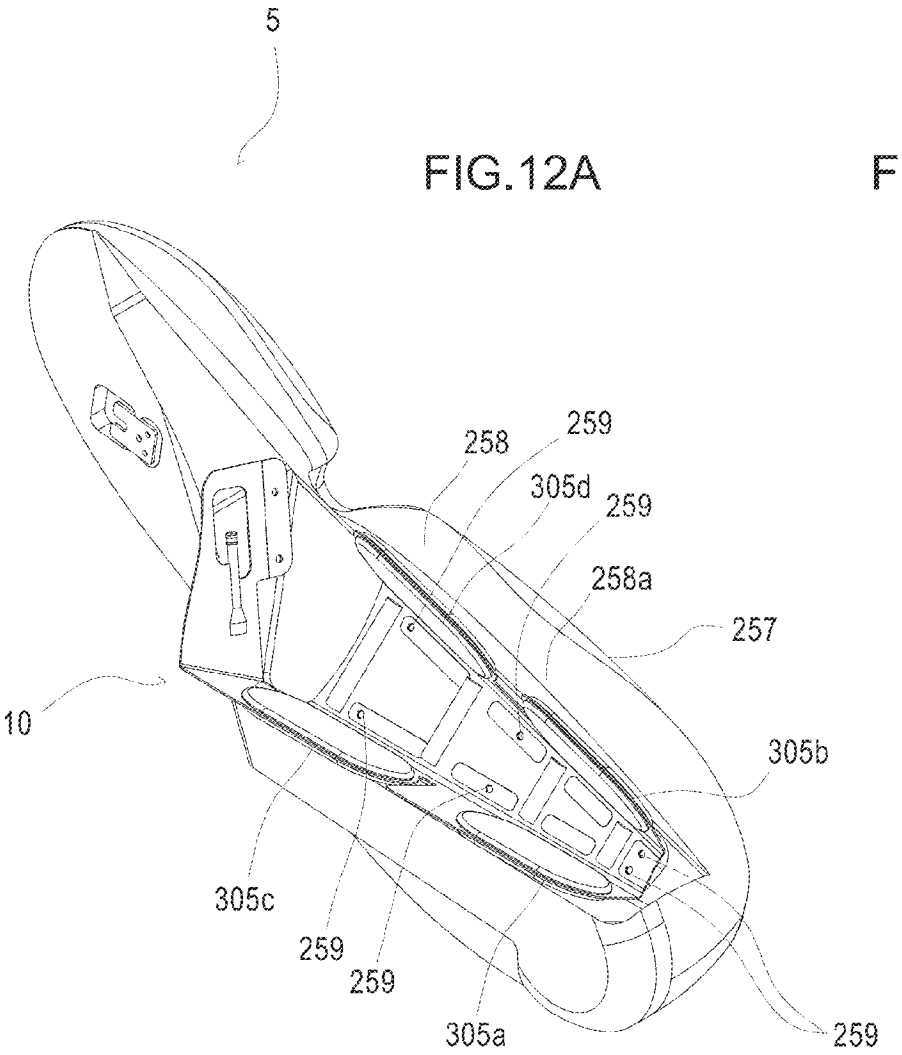
FIG. 12A is a diagram showing the perspective view of the armrest part of the chair type massage machine according to the embodiment of the present invention.

FIGS. 11 and 12 are diagrams showing the armrest parts 5 of the chair type massage machine 1. FIG. 11 is a diagram showing a cross-sectional shape of the armrest part 5. FIG. 12A is a perspective view of the armrest part 5. FIG. 12B is a diagram of the armrest part when viewed from the upper side.

Opposite side surfaces of the seat part 3 are provided with the armrest parts 5, and the armrest parts 5 are attached from the seat part 3 to the backrest part 2 so as to be able to support hand parts, lower arm parts, and upper arm parts of the person to be treated.

The inside of each armrest part 5 is formed of a first inner surface 251, a second inner surface 252, a third inner surface 253, and an opening 254 so as to be able to hold the hand parts and the lower arm parts in the armrest part 5. In addition, the cross-sectional shape of each armrest part 5 is a U shape, and the opening 254 is directed obliquely upward.

The second inner surface 252 in the cross-sectional state includes a first bonding part 255, which is bonded to the first inner surface 251, at one end and a second bonding part 256, which is bonded to the third inner surface 253, at the other end, and by attaching one end of the first inner surface 251 to the first bonding part 255 and attaching one end of the third inner surface 253 to the second bonding part 256, the other end of the first inner surface 251 and the other end of the third inner surface 253 are positioned on the side of the opening 254. Furthermore, the U shape is formed by attaching the third inner surface 253 to the second bonding part 256 so as to be located at an upper position than that of the first inner surface 251 and attaching the first inner surface 251 to the first bonding part 255 so as to be located at a lower position than that of the third inner surface 253. With such arrangement, the second inner surface 252 is fixed at a predetermined angle, and the opening 254 can be directed obliquely upward. In addition, the right and left armrest parts 5 have symmetry structures.

In addition, the outside of each armrest part 5 is formed of an outer surface 257 which covers the side of the armrest part 5 and an upper surface 258 which is provided so as to extend from a position above the outer surface 257 toward the side of the seat part. The upper surface 258 is provided from a side of a hand to a side of an elbow of the person to be treated, and a mid-way part 258*a* disposed between the side of the hand and the side of the elbow extends to the maximum extent to the side of the seat part, and the length of the upper surface 258 is reduced by the amount corresponding to the extending part of the upper surface 258 from the mid-way part 258*a* as a vertex toward the side of the hand and toward the side of the elbow. In other words, the upper surface 258 of the armrest part 5 has a shape obtained by cutting the side of the hand and the side of the elbow. In addition, the third inner surface 253 of the fifth massage part 10 also has a shape obtained by cutting the side of the hand and the side of the elbow.

The armrest part 5 shown in FIG. 12 includes the fifth massage part 10, and the fifth massage part 10 is configured of an air treatment part. A hand air cell LA305*a*, a hand air cell LB305*b*, a hand air cell RA306*a*, and a hand air cell RB306*b* which are for treating the hand parts of the person to be treated and a lower arm air cell LA305*c*, a lower arm air cell LB305*d*, a lower arm air cell RA306*c*, and a lower arm air cell RB306*d* which are for treating the lower arm parts of the person to be treated are provided.

Although a description will be given of an example of the armrest part 5 on the left side herein, the armrest part 5 on the right side has the same configuration. The hand air cell LA305*a* and the lower arm air cell LA305*c* are positioned at the first inner surface 251 of the armrest part 5, and the hand air cell LB305*b* and the lower arm air cell LB305*d* are provided so as to be positioned at the third inner surface 253 of the armrest part 5. In addition, the hand air cell LA305*a*, the hand air cell LB305*b*, the lower arm air cell LA305*c*, and the lower arm air cell LB305*d* are configured to be fixedly attached to the second inner surface 252.

Accordingly, the second inner surface 252 is provided with fixedly attaching holes 259 at positions corresponding to the hand air cell LA305*a*, the hand air cell LB305*b*, the lower arm air cell LA305*c*, and the lower arm air cell LB305*d*. In addition, the armrest part 5 may be provided with a shoulder air cell L304*a* and a shoulder air cell R304*b* as shown in FIG. 4. The shoulder air cell L304*a* and the shoulder air cell R304*b* are air cells which are for pressurizing the upper arms and the shoulders of the person to be treated from the lateral direction or from the front direction and are provided so as to be able to pinch and pressurize the upper arms and the shoulders of the person to be treated with a rear air cell L302*a* and a rear air cell R302*b* provided at the backrest part 2 of the third massage part 8. In addition, the attachment positions of the shoulder air cell L304*a* and the shoulder air cell R304*b* for the upper arms may be at the armrest part 5, or alternatively, the shoulder air cell L304*a* and the shoulder air cell R304*b* may be directly attached to the side surfaces of the backrest part 2 and provided so as to project from the sides of the backrest part 2.

The footrest 4 is provided at a front part of the seat part 3 and includes the second massage part 7 arranged therein. The footrest 4 holds the foot parts of the person to be treated.

The control part 31 provided at the seat part 3 receives a signal from the operation part 33 and drives the air supply and discharge device 32 which supplies and discharge air to and from the respective air cells. In addition, the air supply and discharge device 32 includes electromagnetic valves I to XI as shown in FIG. 4, and the respective electromagnetic valves supply and discharge air to and from the air cells when ports thereof are opened. In addition, the air supply and discharge device 32, the respective electromagnetic valves, and the respective air cells are connected by piping.

The electromagnetic valve I36*a* is an electromagnetic valve which supplies and discharge air to and from an ejecting air cell L301*a* of the advancing and retreating mechanism 90 of the left massage unit 14 of the first massage part 6. The squeezing 37*a* is provided in the middle of the electromagnetic valve I36*a* and the ejecting air cell L301*a* of the advancing and retreating mechanism 90. In addition, the ejecting air cell L301*a* can operate independently from the ejecting air cell R301*b* which will be described later and also can expand and contract at the same timing in synchronization with the ejecting air cell R301*b*. The electromagnetic valve II36*b* is an electromagnetic valve which supplies and discharges air to and from the ejecting air cell R301*b* of the advancing and retreating mechanism 90 of the right massage unit 15 of the first massage part 6. The squeezing 37*a* is provided in the middle of the electromagnetic valve II36*b* and the ejecting air cell L301*a* of the advancing and retreating mechanism 90. In addition, the ejecting air cell R301*b* can operate independently from the ejecting air cell L301*a* and also can expand and contract at the same timing in synchronization with the ejecting air cell L301*a*.

The electromagnetic valve III36*c* is an electromagnetic valve which supplies and discharges air to and from the rear air cell L302*a* and the rear air cell R302*b* provided at the shoulder portions of the backrest part 2. The rear air cell L302*a* and the rear air cell R302*b* are synchronized and expand and contract at the same timing. In addition, it is possible to pinch and pressurize the upper arm parts and the shoulder parts of the person to be treated by driving the rear air cell L302*a*, the rear air cell R302*b*, and the electromagnetic valve V36*e* which will be described later and causing the shoulder air cell L304*a* and the shoulder air cell R304*b* to expand.

The electromagnetic valve IV36*d* is an electromagnetic valve which supplies and discharge air to and from the lower back air cell L303*a* and the lower back air cell R303*b* provided at the lower back portion of the backrest part 2. The lower back air cell L303*a* and the lower back air cell R303*b* are synchronized and expand and contract at the same timing. In addition, it is possible to fix and hold the lower back air cell L303*a* and the lower back air cell R303*b* at the lower back of the person to be treated by causing the lower back air cell L303*a* and the lower back air cell R303*b* to expand.

The electromagnetic valve V36*e* is an electromagnetic valve which supplies and discharges air to and from the shoulder air cell L304*a* and the shoulder air cell R304*b* provided at the upper arm portions of the armrest parts 5. The shoulder air cell L304*a* and the shoulder air cell R304*b* are synchronized and expand and contract at the same time. As described above, it is possible to pinch and pressurize the upper arm parts and the shoulder parts of the person to be treated by causing the rear air cell L302*a*, the rear air cell R302*b*, the shoulder air cell L304*a*, and the shoulder air cell R304*b* to expand.

Since the electromagnetic valve VI36*f* and the electromagnetic valve VII36*g* have the same configurations though there is a difference in where to be arranged in either one of the right side and the left side, a description will be given of an example of the electromagnetic valve VI36*f*. The electromagnetic valve VI36*f* is an electromagnetic valve which supplies and discharges air to and from the hand air cell LA305*a*, the hand air cell LB305*b*, the lower arm air cell LA305*c*, and the lower arm air cell LB305*d* provided at the armrest parts 5. The squeezing 37*b* is provided in the middle of the lower arm air cell LA305*c* and the lower air cell LB305*d*. The squeezing 37*b* is provided at the lower arm air cells in order to differentiate timing of the treatment by delaying expansion of the lower arm air cell LA305*c* and the lower arm air cell LB305*d* as compared to the hand air cell LA305*a* and the hand air cell LB305*b*. In addition, the electromagnetic valve VI36*f* and the electromagnetic valve VII36*g* are not made to expand at the same time and are made to expand one by one. Since it is difficult for the person to be treated to escape from the chair type massage machine 1 in an emergency if both arms are treated at the same time, the electromagnetic valves are operated one by one.

Since the electromagnetic valve VIII36*h* and the electromagnetic valve IX36*j* have the same configurations though there is a difference in where to be arranged in either one of the right side and the left side, a description will be given of an example of the electromagnetic valve VIII36*h*. The electromagnetic valve VIII36*h* is an electromagnetic valve which is provided at the seat part 3 and supplies and discharges air to and from the seat air cell L307 on the side of the hip part of the person to be treated. Since the electromagnetic valve VIII36*h* and the electromagnetic valve IX36*j* can be independently operated, it is possible to perform stretch operations by pressing and pressurizing the right and left sides of the hip part and causing the electromagnetic valve VIII36*h* and the electromagnetic valve IX36*j* to expand alternately on the right and left sides.

The electromagnetic valve X36*j* is an electromagnetic valve which is provided at the seat part 3 and supplies and discharge air to and from the seat air cell A309 for pressurizing thigh parts near the knees of the person to be treated from the rear surfaces. It is possible to press upward the knee portions of the person to be treated by causing the seat air cell A309 to expand.

The electromagnetic valve XI36*k* is an electromagnetic valve which is provided at the footrest 4 and supplies and discharges air to and from the advancing and retreating air cell 310 which causes the second massage part 7 to advance toward and retreat from the person to be treated. It is possible to cause the second massage part 7 to advance toward the side of the person to be treated by causing the advancing and retreating air cell 310 to expand.

In addition, it is possible to cause the respective air cells to expand and contract and perform complex treatment by opening and closing the plurality of electromagnetic valves I to XI. For example, it is possible to perform massage to stretch muscles of the back since the first massage part 6 is elevated in a state where the treatment elements 81 are made to project toward the body if the first massage part 6 is elevated by supplying air to the ejecting air cell L301*a* and the ejecting air cell R301*b* by the electromagnetic valve I36*a* and the electromagnetic valve II36*b*.

In addition, it is possible to obtain a state where the lower back part is fixed while the hip part floats by supplying air to the lower back air cell L303*a*, the lower back air cell R303*b*, the seat air cell L307, and the seat air cell R308 by the electromagnetic valve IV36*d*, the electromagnetic valve VIII36*h*, and the electromagnetic valve IX36*j*. By performing the kneading massage and the tapping massage in this state, it is possible to perform massage on a part from the hip part to the lower back, which cannot be treated if the person to be treated is seated on the chair type massage machine 1.

Figure 13A:
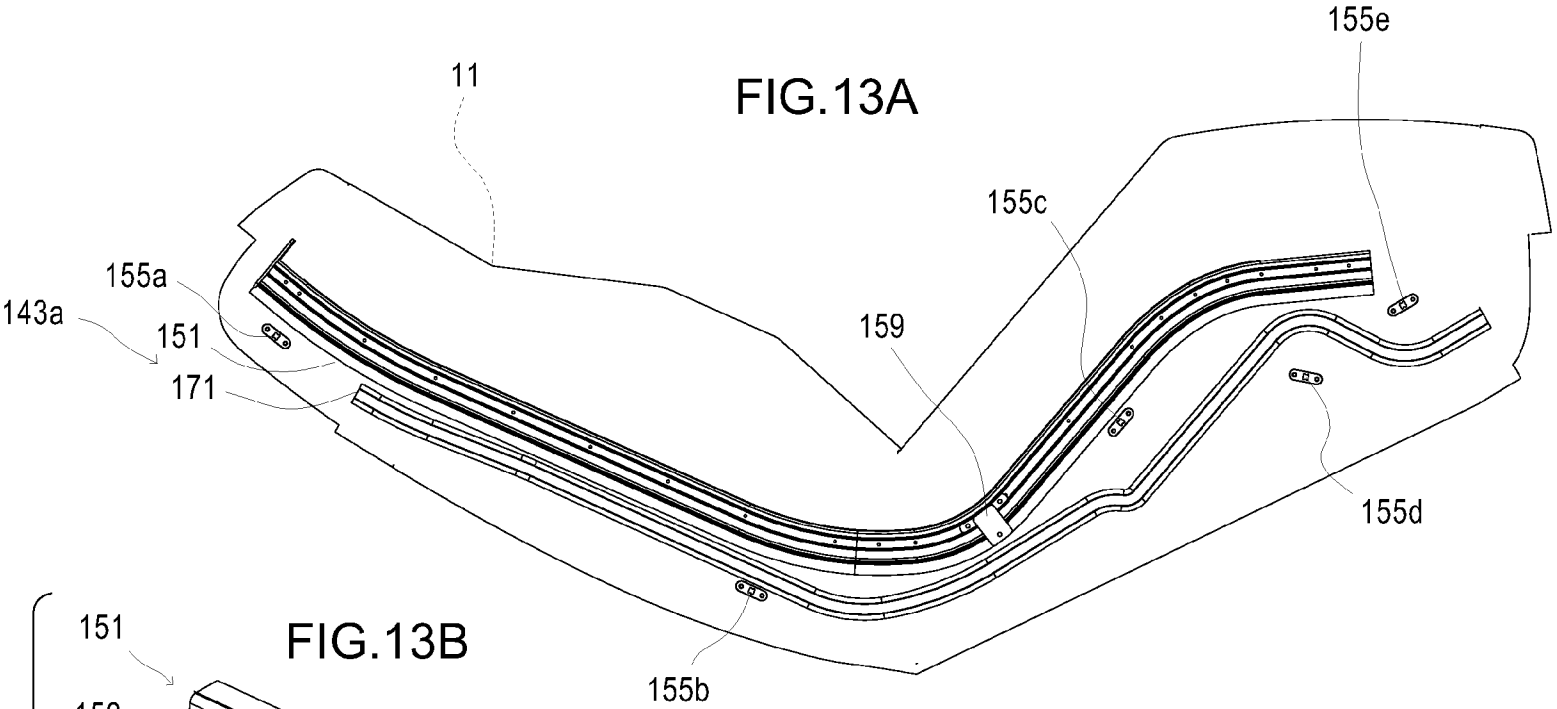
FIG. 13A is a diagram showing a first guide rail and a second guide rail of the chair type massage machine according to the embodiment of the present invention.
Figure 13B:
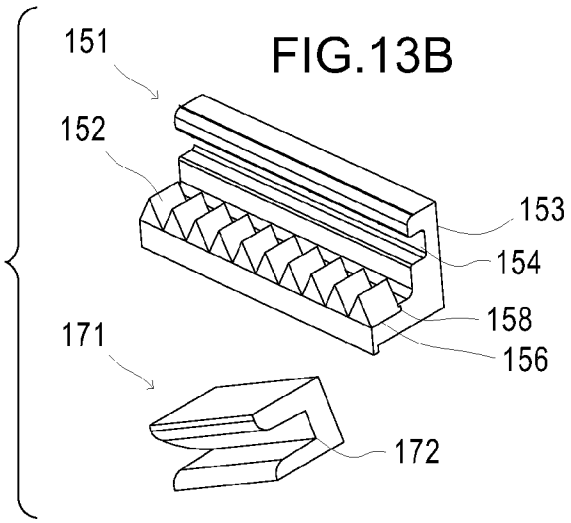
FIG. 13B is a diagram showing cross-sectional shapes of the first guide rail and the second guide rail.
Figure 15A:
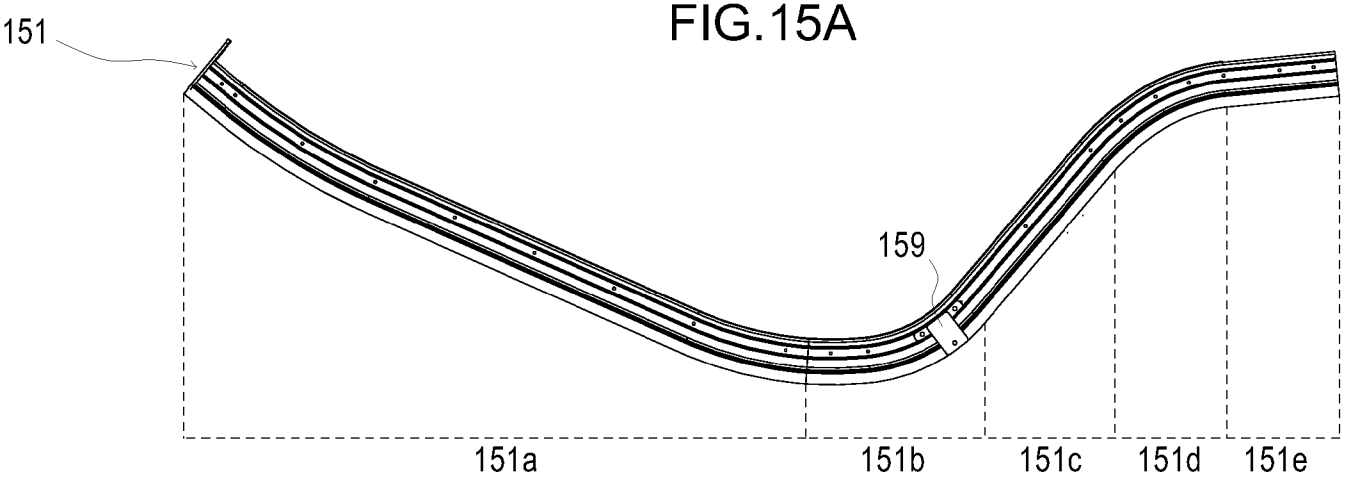
FIG. 15A is a diagram showing the first guide rail of the chair type massage machine according to the embodiment of the present invention.
Figure 15B:
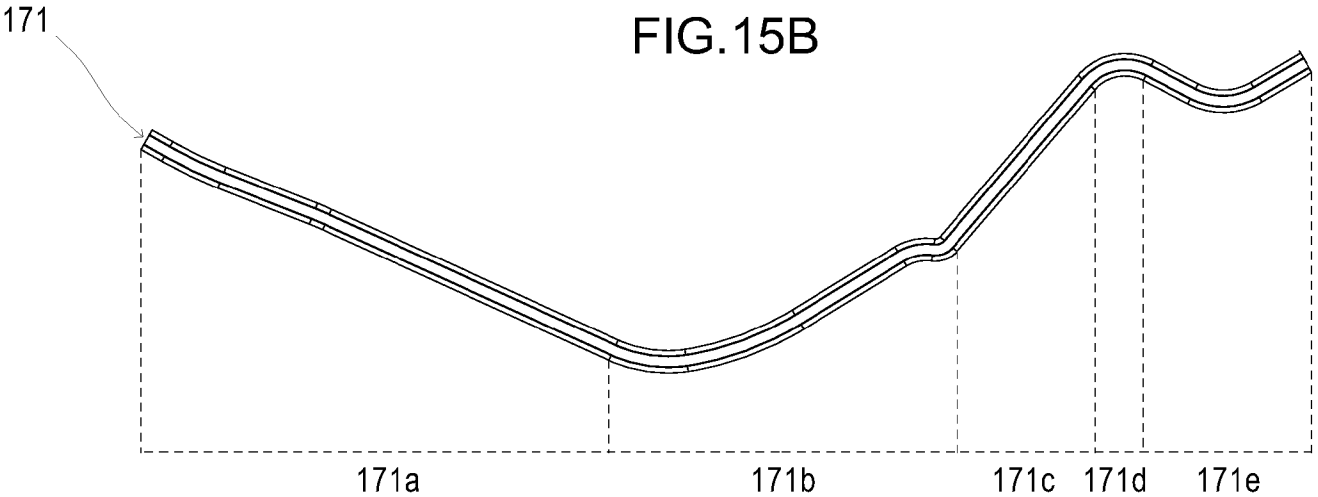
FIG. 15B is a diagram showing the second guide rail of the chair type massage machine according to the embodiment of the present invention.

FIG. 13 is a diagram showing the first guide rail 151 and the second guide rail 171 of the chair type massage machine 1. FIG. 13A is a diagram showing the first guide rail 151 and the second guide rail 171. FIG. 13B is a diagram showing cross-diagram showing the first guide rail 151. FIG. 15 is a diagram showing the first guide rail and the second guide rail of the chair type massage machine according to the embodiment of the present invention. FIG. 15A is a diagram showing the first guide rail 151. FIG. 15B is a diagram showing the second guide rail 171. The pair of right and left first guide rails 151 and the pair of right and left second guide rails 171 are provided. The right and left first guide rails 151 and the right and left second guide rails 171 have the same shapes.

Since the pair of right and left first guide rails 151 and the pair of right and left second guide rails 171 are provided so as to have the same shapes, a description will be given of examples of the first guide rail 151 on the left side and the second guide rail 171 on the right side. The first guide rail 151 is integrally provided in a longitudinal direction of the body of the person to be treated and is provided from the head part to the leg part. The first guide rail 151 includes a first movement region 141 which is provided so as to successively extend from a position corresponding to the backrest part 2 to a position corresponding to the seat part 3 via the curved part 141*a* and a second movement region 142 which is provided so as to successively extend from a position corresponding to the footrest 4 to the position corresponding to the seat part 3 via the curved part 142*a*, and the first massage part 6 includes the first elevation mechanism 65 and moves in the first movement region 141 by being driven by the first elevation mechanism 65. In addition, the first massage part 6 may be movable from the first movement region 141 to the second movement region 142. The second massage part 7 includes the second elevation mechanism 204 and moves in the second movement region 142 by being driven by the second elevation mechanism 204. In addition, the second massage part 7 may be movable from the first movement region 141 to the second movement region 142.

With such a configuration, the first massage part 6 can perform massage on a plurality of locations to be treated while moving from the first movement region 141 to the second movement region 142. The second massage part 7 can perform massage while moving from the second movement region 142 to the first movement region 141. That is, it is possible to simultaneously perform massage on the same body part to be treated or simultaneously perform massage on different body parts in the height direction, and for example, the first massage part can massage the trunk part while the second passage part massages the leg parts. In addition, since the guide rail is formed from the position corresponding to the backrest part to the position corresponding to the footrest via the curved part, it is possible to sufficiently massage a boundary between the lower back part and the hip part and a boundary between the thigh parts and the calves and thoroughly massage the body parts from the trunk part to the lower body. In addition, the first movement region 141 in which the first massage part 6 moves is within a range from the backrest part 2 to the mid-way part of the seat part 3, and the second movement region 142 in which the second massage part 7 moves is within a range from the footrest 4 to the mid-way part of the seat part 3.

In addition, FIG. 14 shows a collision preventing region 145. The collision preventing region 145 is positioned from the mid-way part of the first movement region 141 to the mid-way part of the second movement region 142. In the collision preventing region 145, a detected part 155*b* and a detected part 155*c* which are collision preventing means which will be described later are arranged. In addition, stoppers 159 as collision preventing means are positioned between the detected part 155*b* and the detected part 155*c* which will be described later such that the first massage part 6 and the second massage part 7 cannot move beyond the stoppers 159. In addition, the control part 31 which detects signals of the detected part 155*b* and the detected part 155*c* which will be described later and controls the first massage part 6 and the second massage part 7 also functions as collision preventing means.

The first guide rail 151 shown in FIG. 13B has an L shape in the cross-sectional view and has a bottom part 156 and the side wall part 153. The bottom part 156 and the side wall part 153 respectively include grooves. The groove 154 of the side wall part 153 holds the extending part 67*b* of the first shaft body 67 of the first massage part 6 and the first shaft body 222*b* of the second massage part 7. In addition, a groove 158 of the bottom part 156 is for fixing the rack 152 for elevating the first massage part 6 and the second massage part 7, and an opening end of the groove 158 has a hook shape. The end part of the rack 152 can be fixed at the portion with the hook shape.

The second guide rail 171 shown in FIG. 13B has a U shape in the cross-sectional view. The groove 172 with the U shape holds the second shaft body 68 of the first massage part 6 and the second shaft body 223 of the second massage part 7. In addition, the first shaft body 67 and the second shaft body 68 of the first massage part 6 are arranged at linearly symmetrical positions, and the first shaft body 222 and the second shaft body 223 of the second massage part 7 are also arranged at lineally symmetrical positions. For this reason, the first guide rail 151 is arranged at a position closer to the side of the person to be treated, the second guide rail 171 is arranged at a position behind the first guide rail 151, which is further from the person to be treated as compared with the first guide rail 151, and therefore, the linearly arranged first shaft body 67 and second shaft body 68 of the first massage part 6 and linearly arranged first shaft body 222*b* and the second shaft body 223 of the second massage part 7 can be held at the first guide rail 151 and the second guide rail 171.

Figure 16:
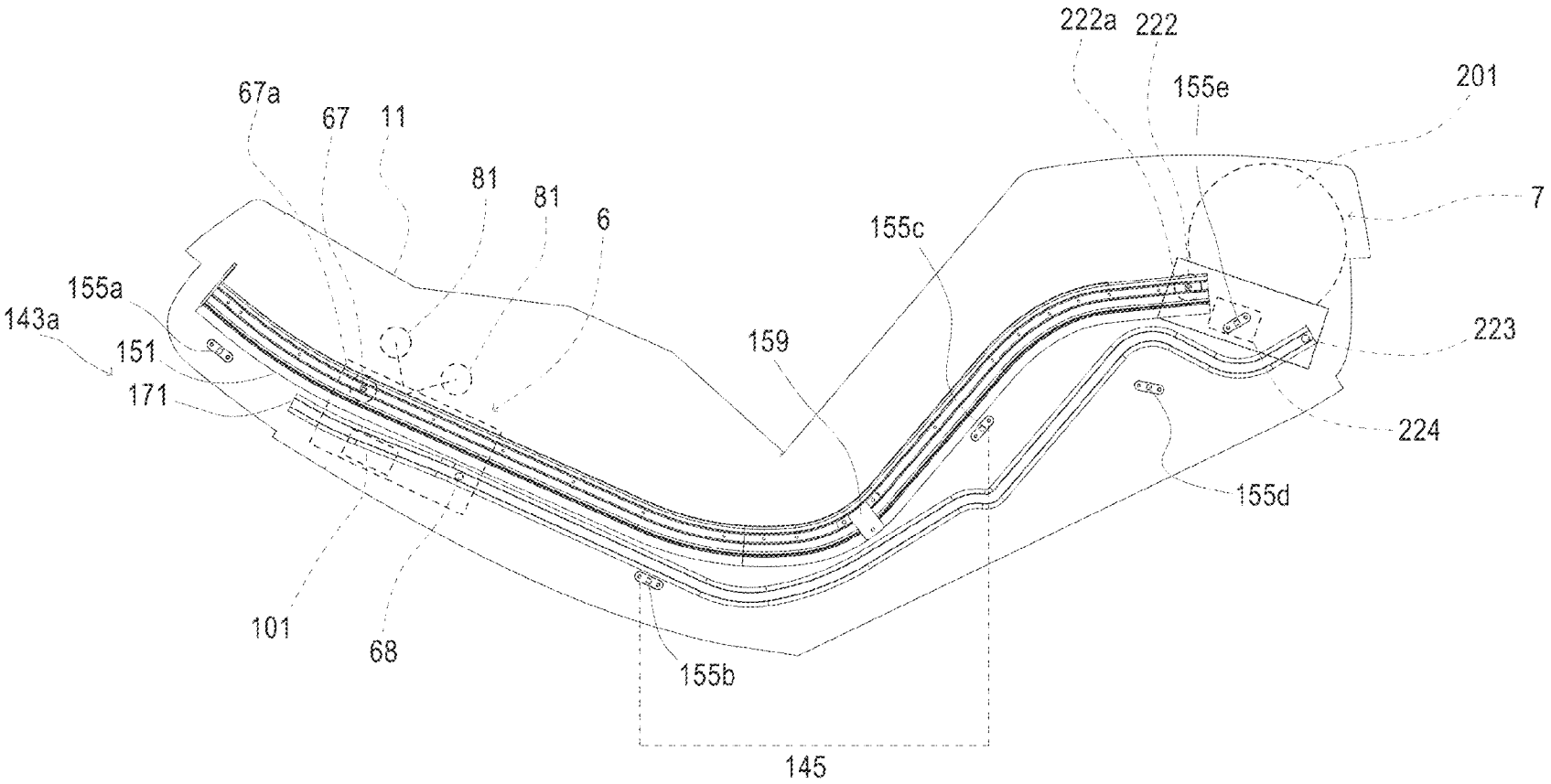
FIG. 16 is a diagram showing positions of the first massage part and the second massage part of the chair type massage machine according to the embodiment of the present invention.
Figure 17:
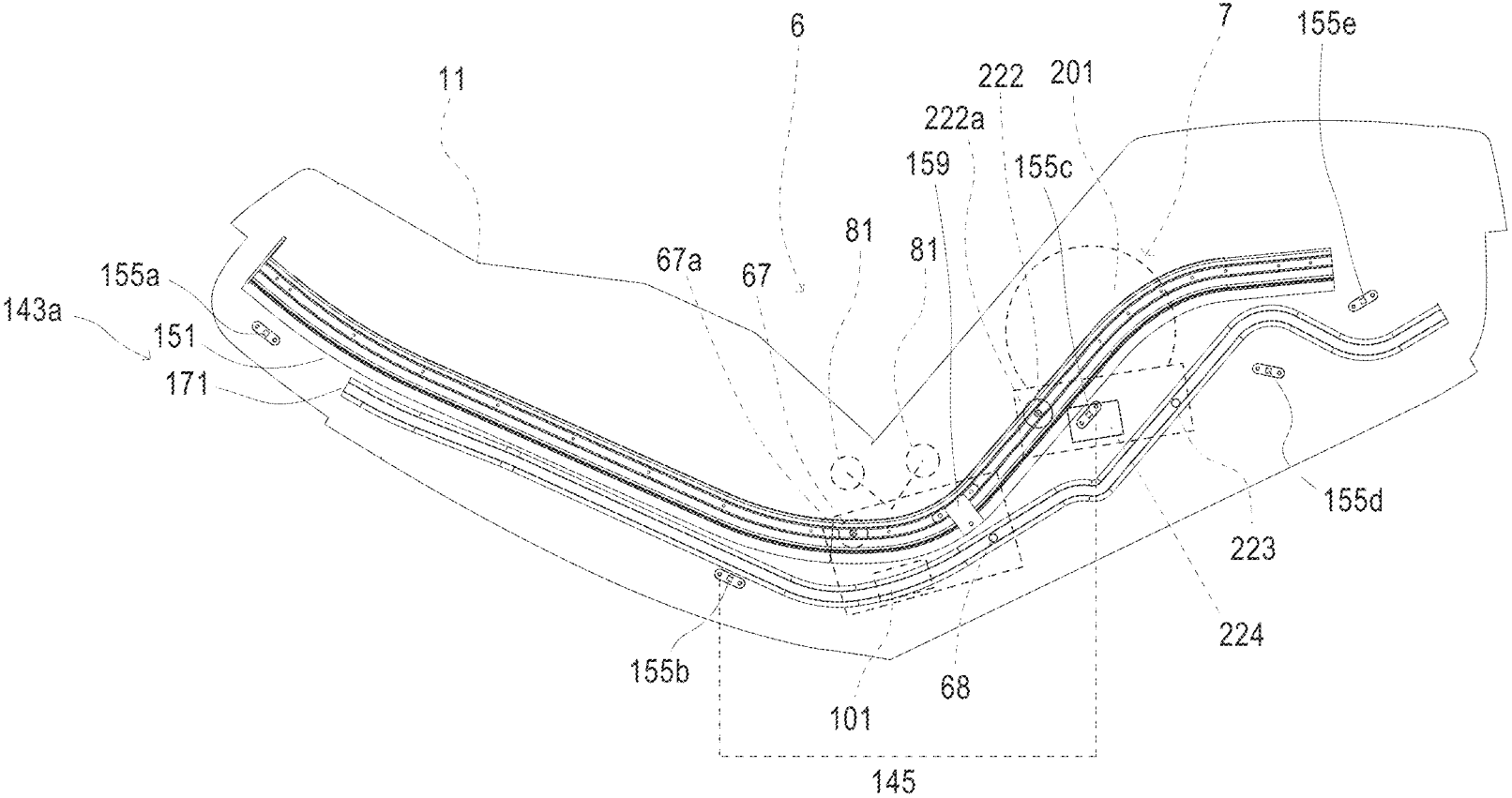
FIG. 17 is a diagram showing positions of the first massage part and the second massage part of the chair type massage machine according to the embodiment of the present invention.
Figure 18:
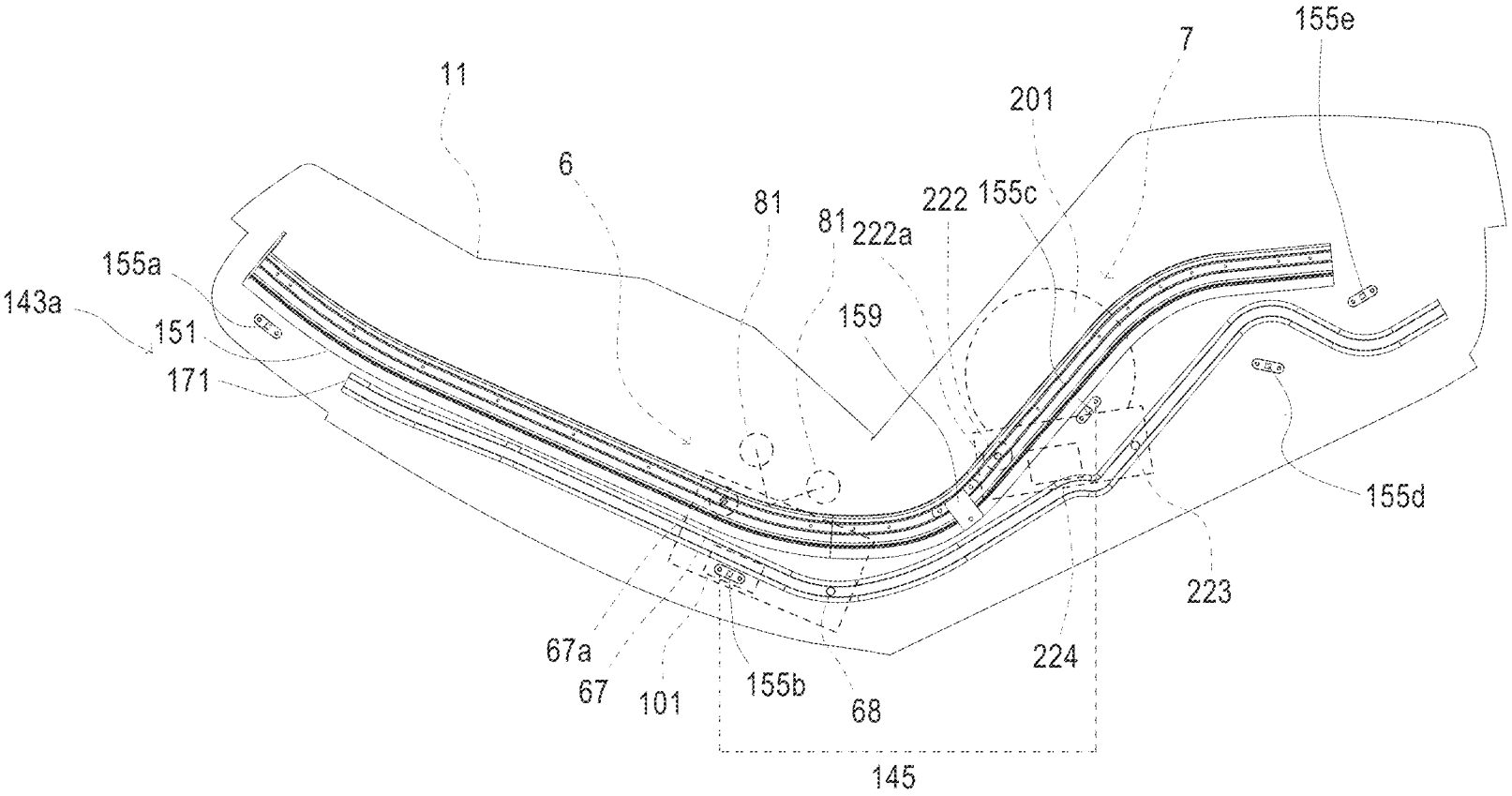
FIG. 18 is a diagram showing positions of the first massage part and the second massage part of the chair type massage machine according to the embodiment of the present invention.

In addition, the postures of the first massage part 6 and the second massage part 7 are changed by the positional relationship between the first guide rail 151 and the second guide rail 171 in a state where the first shaft body 67 of the first massage part 6 and the first shaft body 222 of the second massage part 7 are held at the first guide rail 151 and the second shaft body 68 of the first massage part 6 and the second shaft body 223 of the second massage part 7 are held at the second guide rail 171 as shown in FIGS. 16 to 18. The first massage part 6 is substantially parallel with the person to be treated if the first guide rail 151 is located at a position closer to the second guide rail 171, and the first massage part 6 is brought into an inclined state with respect to the person to be treated if the first guide rail 151 is located at a position far from the second guide rail 171, for example.

As described above, the chair type massage machine 1 includes posture changing means for changing postures of the first massage part 6 and the second massage part 7. The first guide rails 151 and the second guide rails 171 provided at the chair main body 11 function as a posture changing body 143*a* which changes the postures of the first massage part 6 and the second massage part 7 by the positional relationship thereof. The second shaft body 68 of the first massage part 6 and the second shaft body 223 of the second massage part 7 deliver variations in the positional relationship between the first guide rails 151 and the second guide rails 171 as the posture changing body 143*a* to the first massage part 6 and the second massage part 7 and function as posture change affected bodies 68 and 223 which are affected by the posture change action of the posture changing body 143*a*.

As described above, the chair type massage machine 1 includes the posture changing means, the posture changing means includes the posture changing body 143*a* and the posture change affected bodies 68 and 223, the posture changing body 143*a* is provided at the chair main body 11, and the posture change affected bodies 68 and 223 are provided at the first massage part 6 and the second massage part 7.

In addition, the posture changing body 143*a* includes a posture maintaining region in which the postures of the first massage part 6 and the second massage part 7 are maintained and a posture changing region in which the postures of the first massage part 6 and the second massage part 7 are changed. The posture changing region is a region in which spacing between the first guide rails 151 and the second guide rails 171 are changed. The postures of the first massage part 6 and the second massage part 7 are changed by changing the spacing. The posture maintaining region is a region in which the spacing between the first guide rails 151 and the second guide rails 171 is not changed, and the first massage part 6 and the second massage part 7 are maintained at the same posture in the region. As for the spacing, the postures of the first massage part 6 and the second massage part 7 change in a direction toward the person to be treated when the second guide rails 171 are arranged at positions with a short distance from the first guide rails 151, and the postures of the first massage part 6 and the second massage part 7 changes in a direction away from the person to be treated when the second guide rails 171 are arranged at positions with a long distance from the first guide rails 151.

In addition, each of the first guide rails 151 include a first region 151*a* corresponding to the head part to the lower back part of the person to be treated, a second region 151*b* corresponding to the lower back part to the hip part, a third region 151*c* corresponding to the hip part to the thigh parts, a fourth region 151*d* corresponding to the knee parts, and a fifth region 151*e* corresponding to the leg parts. The first guide rail is configured to approach to the side of the person to be treated as the first region 151*a* of the first guide rail approaches the vicinity of the head part and the lower back part. The second region 151*b* of the first guide rail is bent in accordance with the bending of the person to be treated in the seated posture from the lower back part to the hip part. The third region 151*c* of the first guide rail is formed into a substantially flat shape without undulations. The fourth region 151*d* of the first guide rail is bent in accordance with the bending of the knee parts of the person to be treated in the seated posture. The fifth region 151*e* of the first guide rail is formed into a substantially flat shape without undulations.

Each of the second guide rails 171 includes a sixth region 171*a* corresponding to the first region 151*a*, a seventh region 171*b* corresponding to the second region 151*b*, a eighth region 171*c* corresponding to the third region 151*c*, a ninth region 171*d* corresponding to the fourth region 151*d*, and a tenth region 171*e* corresponding to the fifth region 151*e*. The sixth region 171*a* of the second guide rail 171 has a shape with a center which smoothly projects toward the side of the person to be treated, and the spacing between the first guide rail 151 and the second guide rail 171 gradually changes. The seventh region 171*b* of the second guide rail 171 has a bent portion in the vicinity of a boundary between the sixth region 171*a* and the eighth region 171*c*. The bent portion located in the vicinity of the boundary between the sixth region 171*a* and the seventh region 171*b* has a shape that the spacing between the first guide rail 151 and the second guide rail 171 depicts an arc by repeating an approaching state, a separated state, and the approaching state toward the center of the seventh region 171*b*.

A bent portion located in the vicinity of the boundary between the eighth region 171*c* and the seventh region 171*b* is bent such that the spacing between the first guide rail 151 and the second guide rail 171 changes from the separated state to the approaching state toward the center of the seventh region 171*b*.

Since the eighth region 171*c* of the second guide rail 171 has a substantially linear shape, and the spacing between the first guide rail 151 and the second guide rail 171 does not change, the eighth region 171*c* is a region where the posture of the first massage part 6 or the second massage part 7 is maintained.

The ninth region 171*d* of the second guide rail is a portion where the posture of the massage unit is greatly changed in accordance with the knee portions of the person to be treated in the seated state. When the second massage part 7 positioned in the eighth region 171*c* moves to the tenth region 171*e*, the knee parts are bent by about 90° since the person to be treated is in the seated state. That is, the second massage part 7 is required to change the posture in accordance with the bending of the knees. Therefore, the ninth region 171*d* is a region where the posture of the second massage part 7 is greatly changed.

The tenth region 171*e* of the second guide rail 171 has a shape of depicting the arc such that the spacing between the first guide rail 151 and the second guide rail 171 is in the approaching state at the boundary between the ninth region 171*d* and the tenth region 171*c*, gradually brought into the separated state toward the vicinity of the center of the tenth region 171*e*, and gradually brought into the approaching state as a distance from the center increases. Since the first guide rails 151 and the second guide rails 171 have the aforementioned configurations, it is possible to change the postures of the first massage part 6 and the second massage part 7 in accordance with body parts of each person to be treated.

In addition, a plurality of detected parts 155 are provided in the vicinities of the first guide rails 151 and the second guide rails 171. The detected parts 155 are detected by a detection part 101 of the first massage part 6 and the detection parts 224 and the initial position detection part 225 of the second massage part 7. As the detected parts 155, a first detected part 155*a* and a second detected part 155*b* are provided on a side of the head part and on a side of the lower back part, respectively, in the first region 151*a*, a third detected part 155*c* is provided at a mid-way part of the third region 151*c*, a fourth detected part 155*d* is provided on a rear side of knees in the fourth region 151*d*, and a fifth detected part 155*e* is provided on a side of foot parts in the fifth region 151*e*.

In addition, the first detected part 155*a*, the second detected part 155*b*, the third detected part 155*c*, the fourth detected part 155*d*, and the fifth detected part 155*e* are formed of magnets, and the detection part 101 of the first massage part 6 and the detection parts 224 and the initial position detection part 225 of the second massage part 7 are configured of hall ICs. In addition, although hall ICs are employed as the detection parts and magnets are employed as the detected parts herein, other detection means may be employed.

The first detected parts 155*a* is a limit sensor for a position corresponding to the upper limit of the movement of the first massage part 6, the second detected part 155*b* is a limit sensor for a position corresponding to the lower limit of the movement of the first massage part 6, the third detected part 155*c* is a limit sensor for a position corresponding to the upper limit of the movement of the second massage part 7, and the fifth detected part 155*e* is a limit sensor for a position corresponding to the lower limit of the movement of the second massage part 7. In addition, the fourth detected part 155*d* determines an initial position of the second massage part 7 and is detected by the initial position detection part 225 of the second massage part 7. In addition, the stoppers 159 are provided in the third region 151*c*. The stoppers 159 are provided in the groove 154 of each first guide rail 151 and at the rack 152 of each first guide rail 151. In addition, the stopper 159 provided at the rack 152 of the first guide rail 151 is formed so as to be fitted into the rack 152 such that the rack 152 can be fixed to the first guide rail 151. The stopper 159 is provided at a mid-way part of the second region 151*b* of the first guide rail 151. Movement of each extending part 67*b* at an end part of the first shaft body 67 of the first elevation mechanism 65 in the first massage part 6 is limited by the stoppers 159, and movement of each pinion 67*a* of the first elevation mechanism 65 in the first massage part 6 is limited by the stopper 159 provided at the rack 152 of the first guide rail 151.

In addition, movement of each extending part 222*b* at an end part of the first shaft body 222 of the second elevation mechanism 204 in the second massage part 7 is limited by the stoppers 159, and movement of each pinion 222*a* of the second elevation mechanism 204 in the second massage part 7 is limited by the stopper 159 provided at the rack 152 of the first guide rail 151. In addition, the second guide rail 7 is not provided with the stopper and the like.

In addition, each pinion 67*a* provided at first shaft body 67 in the first massage part 6 and each extending part 67*b* at the end part move by a distance from the first region 151*a* to the vicinity of the stoppers 159 in the second region 151*b* of the first guide rail 151, and each of opposite end parts of the second shaft body 68 in the first massage part 6 moves from the sixth region 171*a* to a mid-way portion of the eighth region 171*c* of the second guide rail 171. With such a configuration, the first massage part 6 can massage the back part, the lower back part, and the hip part of the person to be treated. Accordingly, the first massage part 6 can perform treatment while moving up to a mid-way portion of the seat part 2.

In addition, each pinion 222*a* provided at the first shaft body 222 in the second massage part 7 and each extending part 222*b* at the end part moves by a distance from the fifth region 151*e* of the first guide rail 151 to the stoppers 159 in the second region 151*b*, and each of the opposite end parts 223*b* of the second shaft body 223 in the second massage part 7 moves from the tenth region 171*e* to the mid-way part of the eighth region 171*c* of the second guide rail 7. With such a configuration, the second massage part 7 can massage ankles, calves, knees, thigh parts, and hip parts of the person to be treated. Accordingly, the second massage part 6 can perform treatment while moving up to the mid-way portion of the seat part 2. That is, the first massage part 6 can move from the backrest part 2 to the mid-way part of the seat part 3, the second massage part 7 can move from the footrest 4 to the mid-way part of the seat part 3, and the seat part 3 is a common region where the first massage part 6 and the second massage part 7 perform massage.

As described above, the first massage part 6 is configured to move from the backrest part 2 to the mid-way part of the seat part 3 due to the structure suitable for treating the upper body, the second massage part 7 is configured to move from the footrest 4 to the mid-way part of the seat part 3 due to the structure suitable for treating the lower body, and it is possible to perform massage suitable for the upper body and the lower body. In addition, the first massage part 6 and the second massage part 7 are controlled by the control part 31 so as not to collide with each other.

FIGS. 17 and 18 are diagrams of a state where one of the first massage part 6 and the second massage part 7 enters the collision preventing region 145. FIG. 17 shows a position of the second massage part 7 when the first massage part 6 moves beyond the limit sensor for the position corresponding to the lower limit, and FIG. 18 shows a position of the first massage part 6 when the second massage part 7 moves beyond the limit sensor for the position corresponding to the upper limit. The control part 31 stops the movement of the second massage part 7 or moves the second massage part 7 in a direction away from the first massage part 6 when the control part 31 detects a signal from the limit sensor for the position corresponding to the lower limit of the first massage part 6, and the control part 31 stops the movement of the first massage part 6 or moves the second massage part 7 in a direction away from the first massage part 6 when the control part 31 detects a signal from the limit sensor for the position corresponding to the upper limit of the second massage part 7.

It is possible to control the first massage part 6 and the second massage part 7 as described above in order not to cause collision between the first massage part 6 and the second massage part 7. In addition, the control may be performed inside the collision preventing region 145, and it is not necessary to constantly monitor the first massage part 6 and the second massage part 7. The limit sensor (detected part 155*b*) for the position corresponding to the lower limit of the first massage part 6, the limit sensor (detected part 155*c*) for the position corresponding to the upper limit of the second massage part 7, and the control part 31, which function as the collision preventing means, enable prevention of the collision between the first massage part 6 and the second massage part 7. In addition, the first massage part 6 can move up to the stoppers 159 even if the detected part 155*b* is detected. The second massage part 7 can move up to the stoppers 159 even if the detected part 155*c* is detected.

Since the region from the detected part 155*b* to the stoppers 159 and the region from the detected part 155*c* to the stoppers 159 are region with a possibility that the first massage part 6 collides with the second massage part 7, the control part 31 performs control of detecting that one of the first massage part 6 and the second massage part 7 enters the predetermined region with the possibility of collision and stopping a massage part which is not in the predetermined region or moving the massage part in a direction away from the predetermined region.

In addition, although the control part 31 performs control of detecting that one of the first massage part 6 and the second massage part 7 enters the predetermined region with the possibility of collision and stopping a massage part which is not in the predetermined region or moving the massage part in a direction away from the predetermined region herein, the control part may move the second massage part 7 to the limit sensor for the position corresponding to the upper limit when the signal from the limit sensor for the position corresponding to the lower limit of the first massage part 6 is detected and may move the first massage part 6 to the position corresponding to the upper limit when the signal from the limit sensor for the position corresponding to the upper limit of the second massage part 7 is detected. By such control, it is possible to move the first massage part 6 to the position corresponding to the lower limit of the first massage part 6, at which there is no possibility of collision with the second massage part 7, if the signal from the limit sensor for the position corresponding to the upper limit of the second massage part 7 is detected even when the first massage part 6 is positioned in the region from the detected part 155*b* to the stoppers 159. Also, it is possible to move the second massage part 7 to the position corresponding to the upper limit of the second massage part 7, at which there is no possibility of collision with the first massage part 6, if the signal from the limit sensor for the position corresponding to the upper limit of the first massage part 6 is detected even when the second massage part 7 is positioned in the region from the detected part 155*c* to the stoppers 159. By such control, it is possible to prevent the first massage part 6 and the second massage part 7 from colliding with each other in the collision preventing region 145 and prevent position control of individual massage parts from being complicated.

A more detailed description will be given of the control of the first massage part 6. The control part 31 controls to stop the movement of the second massage part 7, or move the second massage part 7 in a direction away from the first massage part 6, or move the second massage part 7 up to the limit sensor for the position corresponding to the upper limit when the signal from the detected part 155*b*, which is a limit sensor for the position corresponding to the lower limit of the first massage part 6, and can move the first massage part 6 to the vicinities of the stoppers 159.

In a case of moving the first massage part 6 to the vicinities of the stoppers 159, the control part 31 detects, with a rotation sensor, pulse of the drive source (motor) 61 of the first elevation mechanism 65 of the first massage part 6 and controls the position of the first massage part 6. Pulse numbers from the detected part 155*b* to the stoppers 159 are stored on the control part 31, and the control part 31 moves the first massage part 6 toward the stoppers 159 until a predetermined pulse number is detected, after the detected part 155*b*, which is the limit sensor for the position corresponding to the lower limit of the first massage part 6, is detected. The control is performed as described above such that the first massage part 6 does not collide with the second massage part 7 even if the first massage part 6 moves beyond the position corresponding to the lower limit.

A more detailed description will be given of the control of the second massage part 7. The control part 31 controls to stop the movement of the first massage part 6, or move the first massage part 6 in a direction away from the second massage part 7 when the signal from the detected part 155*c*, which is a limit sensor for the position corresponding to the upper limit of the second massage part 7, and can move the second massage part 7 to the vicinities of the stoppers 159.

In a case of moving the second massage part 7 to the vicinities of the stoppers 159, the control part 31 detects, with a rotation sensor, pulse of the drive source (motor) 220 of the second elevation mechanism 204 of the second massage part 7 and controls the position of the second massage part 7. Pulse numbers from the detected part 155*c* to the stoppers 159 are stored on the control part 31, and the control part 31 moves the second massage part 7 toward the stoppers 159 until a predetermined pulse number is detected, after the detected part 155*c*, which is the limit sensor for the position corresponding to the upper limit of the second massage part 7, is detected. The control is performed as described above such that the second massage part 7 does not collide with the first massage part 6 even if the second massage part 6 moves beyond the position corresponding to the upper limit.

Figure 19:
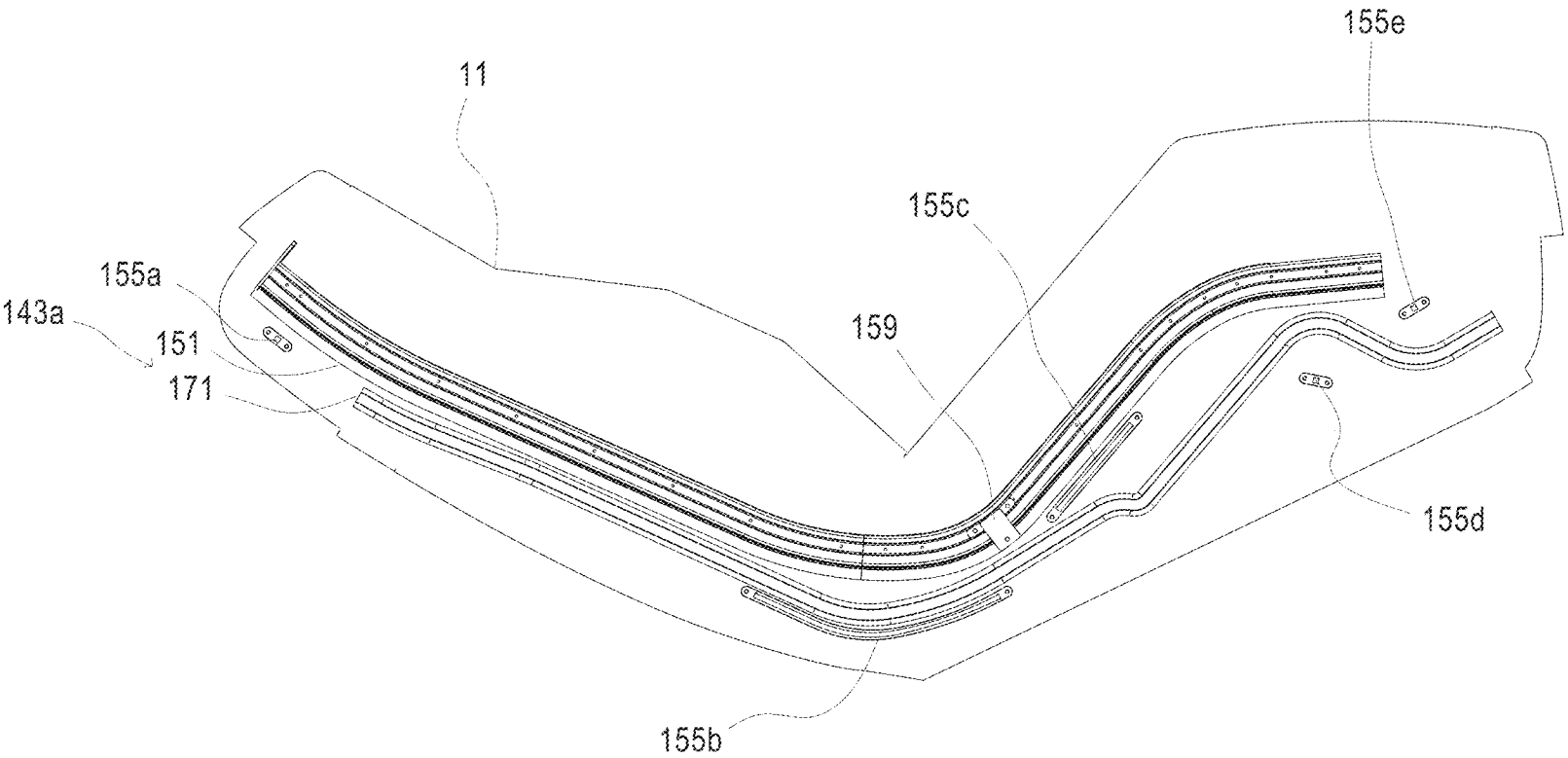
FIG. 19 is a diagram showing detected parts of the chair type massage machine according to the embodiment of the present invention.

In addition, the detected part 155*b* and the detected part 155*c* may be extended and arranged so as to be positioned along the first guide rail 151 and the second guide rail 171 as shown in FIG. 19. The detected part 155*b* and the detected part 155*c* shown in FIG. 19 are installed such that magnet portions are positioned along the guide rails.

When the hall IC of the detection part 101 of the first massage part 6 moves to the magnet portion of the detection part 155*b*, the hall IC of the detection part 101 of the first massage part 6 is brought into an ON state and the ON state is maintained when the hall IC of the detection part 101 is positioned within a range from the position corresponding to the lower limit of the first massage part 6 to the stoppers 159 since the magnet portion of the detected part 155*b* is installed from the position corresponding to the lower limit of the first massage part 6 to the stoppers 159. Then, the control part 31 stops the movement of the second massage part 7 or moves the second massage part 7 in a direction away from the first massage part 6 while the detection part 101 of the first massage part 6 is maintained in the ON state. In addition, when the hall IC of the detection part 244 of the second massage part 7 moves to the magnet portion of the detection part 155*c*, the hall IC of the detection part 244 of the second massage part 7 is brought into an ON state and the ON state is maintained while the hall IC of the detection part 244 is positioned within a range from the position corresponding to the upper limit of the second massage part 7 to the stoppers 159 since the magnet portion of the detected part 155*c* is installed from the position corresponding to the upper limit of the second massage part 7 to the stoppers 159. Then, the control part 31 stops the movement of the first massage part 6 or moves the first massage part 6 in a direction away from the second massage part 7 while the detection part 244 of the second massage part 7 is maintained in the ON state.

Figure 20:
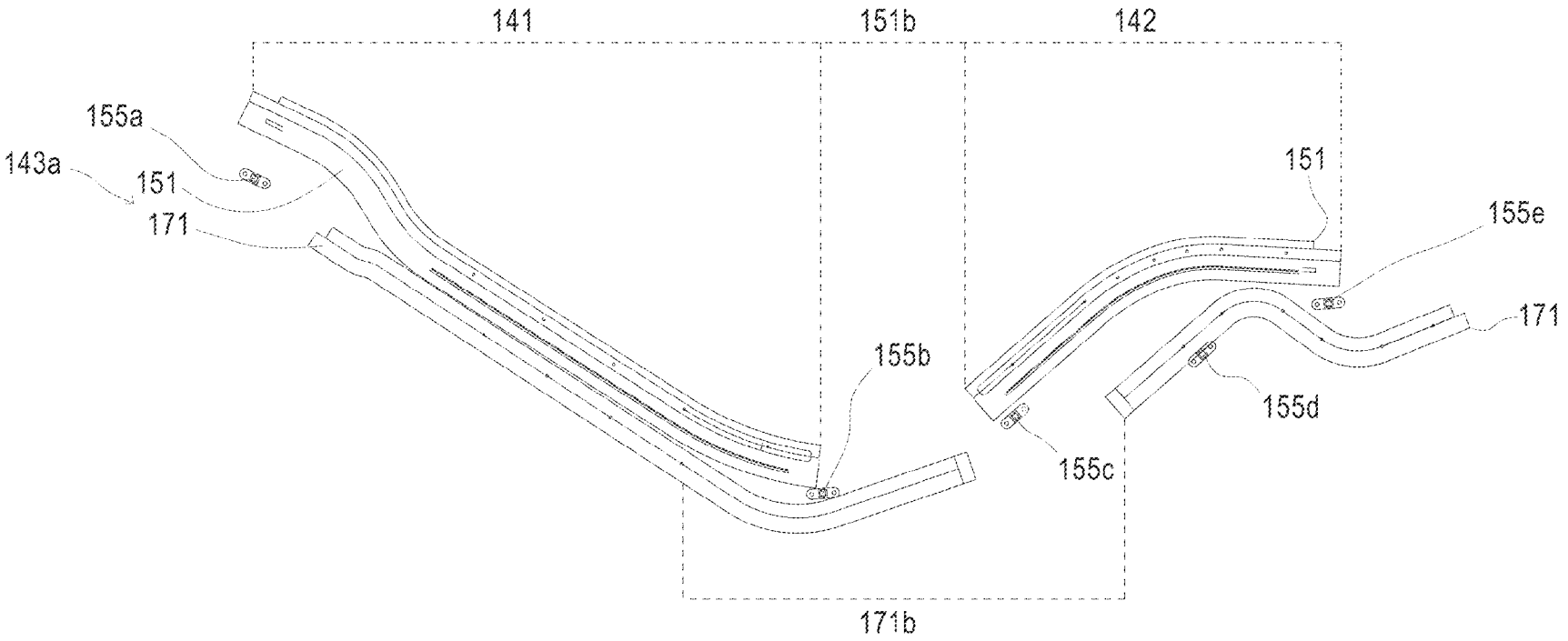
FIG. 20 is a diagram showing a second embodiment of a guide rail of a chair type massage machine according to an embodiment of the present invention.

In addition, the first guide rail 151 may be divided at a mid-way part into the first movement region 141 and the second movement region 142 as shown in FIG. 20. More specifically, the first guide rail 151 is divided into the first movement region 141 and the second movement region 142 except for the portion including the stoppers 159 in the second region 151*b* of the first guide rail 151. In addition, the second guide rail 171 is divided at a mid-way part and divided except for a part of the seventh region 171*b*. In such a case, the attachment position of the detected part 155*a*, which is a limit sensor for the position corresponding to the upper limit of the first massage part 6, is provided at an end part of the first movement region 141 on the side of the head part, and the attachment position of the detected part 155*b*, which is a limit sensor for the position corresponding to the lower limit, is provided at an end part of the first movement region 141 on the side of the lower back part.

With such a configuration, it is possible to prevent the first massage part 6 from falling off from the first movement region 141 of the first guide rail 155 by detecting the detected part 155*a* and the detected part 155*b*. In addition, the attachment position of the detected part 155*c*, which is a limit sensor for the position corresponding to the upper limit of the second massage part 7, is provided at an end part of the second movement region 142 on the side of the hip part, and the attachment position of the detected part 155*e*, which is a limit sensor for the position corresponding to the lower limit, is provided at an end part of the second movement region 142 on the side of the foot parts. In addition, the second guide rail 171 is provided so as to correspond to the split first movement region 141 and the split second movement region 142.

The swing mechanism part 13 is mainly configured of a link member 40 which couples the chair main body 11 to the base 12 so as to be able to swing in the front-back direction and a swing drive part 131 which causes the link member 40 to swing. The link member 40 is attached to the lower part of the chair main body 11 and pivotally supports the chair main body 11 at the base 12 by the first pivot shaft 12*b* so as to be able to swing.

Figure 21:
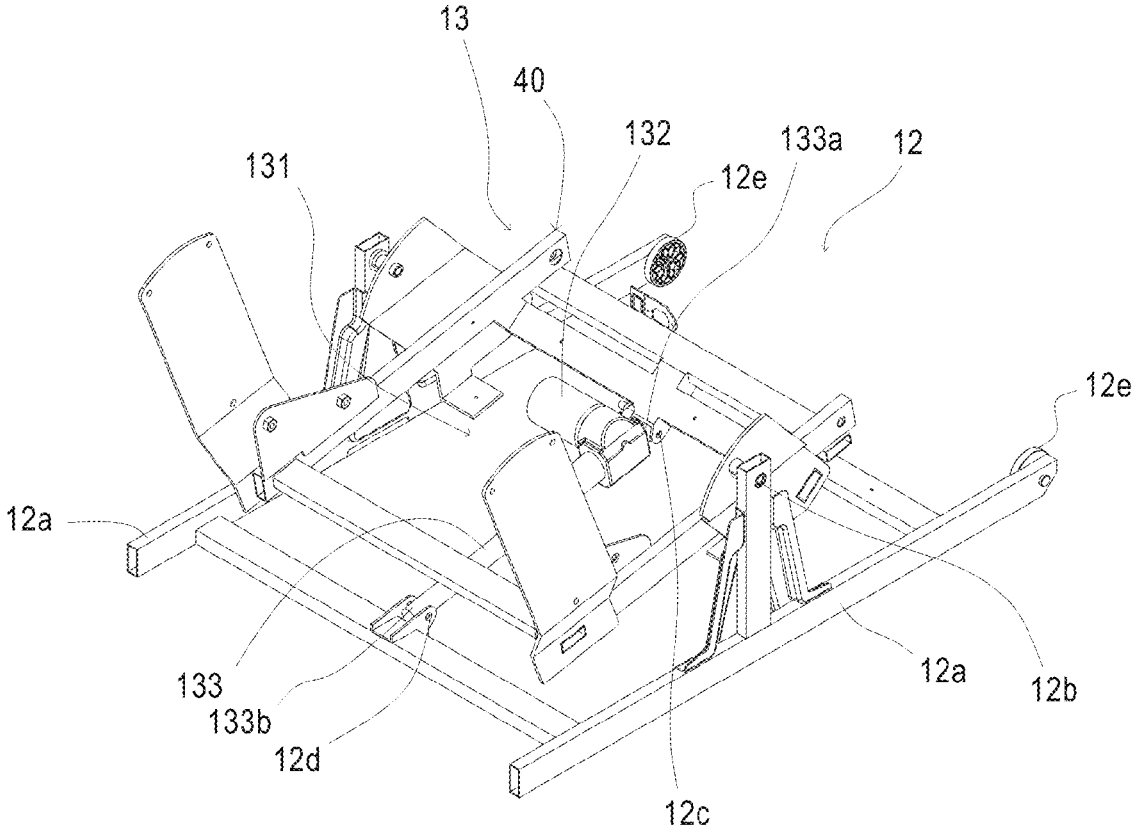
FIG. 21 is a diagram showing a swing mechanism part of the chair type massage machine according to the embodiment of the present invention.

FIG. 21 shows the swing mechanism part 13. As shown in FIG. 21, the swing drive part 131 is configured of a direct operated type actuator including a drive source (motor) 132 and a cylinder 133 which is driven by the drive source (motor) 132 to expand and contract. The swing drive part 131 includes a base part 133*a* pivotally supported via the second pivot shaft 12*c* and a tip end part 133*b* pivotally supported at the base 12 by the third pivot shaft 12*d*.

With such a configuration, it is possible to shift the chair main body 11 in the standing state to the reclined state by driving the swing drive part 131 and shortening the cylinder 133 and shift the chair main body 11 in the reclined state to the standing state by driving the swing drive part 131 and extending the cylinder 133. Then, the chair main body 11 is positioned at an arbitrary position between the standing state and the reclined state by stopping the drive source (motor) 132. In addition, it is possible to perform a rocking operation of causing the chair main body 11 to swing in the front-back direction by successively driving the swing drive part 131.

Figure 22A:
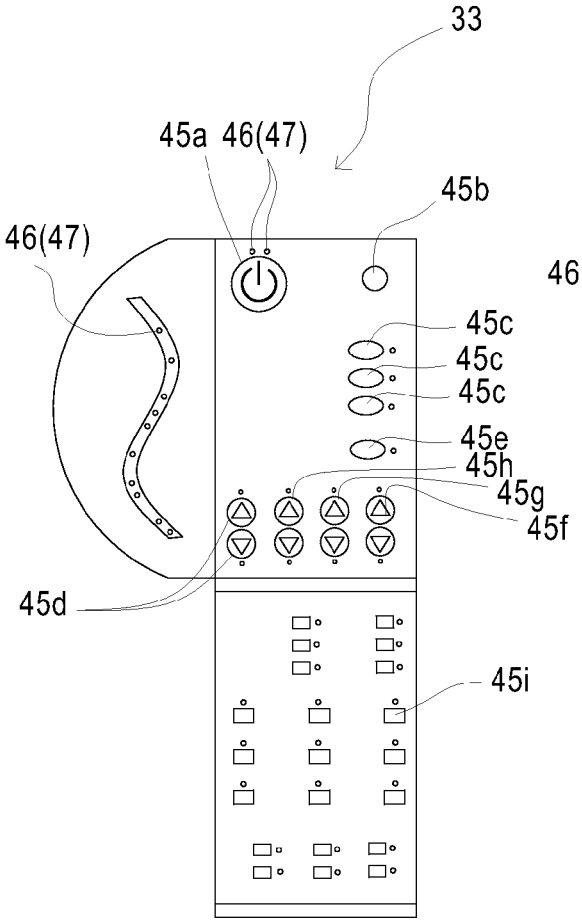
FIG. 22A is a diagram showing an operation part of the chair type massage machine according to the embodiment of the present invention.
Figure 22B:
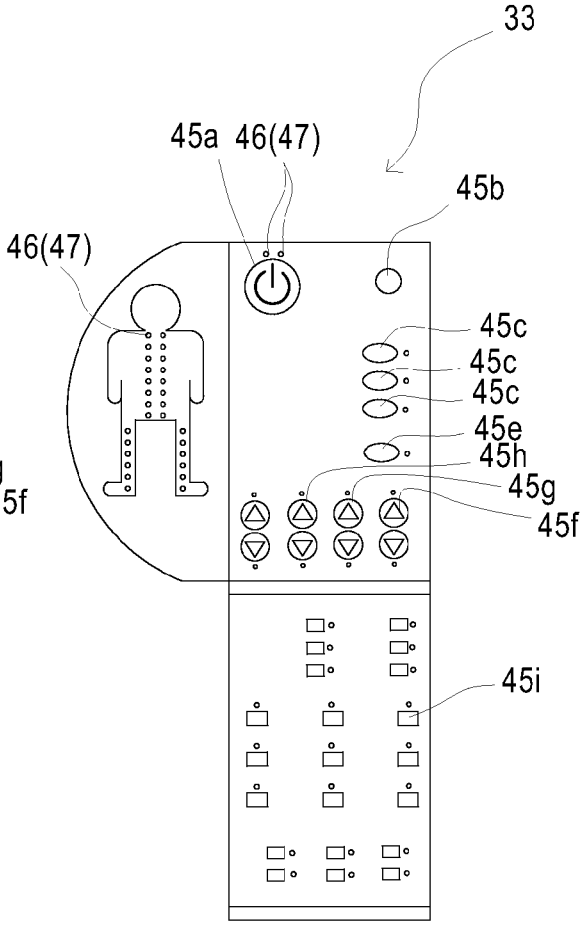
FIG. 22B is a diagram showing an operation part of the chair type massage machine according to the embodiment of the present invention.

FIG. 22 is a diagram showing the operation part 33. FIGS. 22A and 22B show the operation part 33. A plurality of buttons 45 are arranged in the operation part 33, and a power button 45*a* of the chair type massage machine 1, a quick stop button 45*b*, massage course buttons 45*c*, reclining buttons 45*d* for changing inclination of the chair main body 11, a rocking button 45*e*, shoulder position adjusting buttons 45*f*, position change buttons 45*g* for the first massage part 6, position change buttons 45*h* for the second massage part 7, and individual massage buttons 45*j* by which the respective parts to be treated can be individually massaged are provided.

The power button 45*a* in the operation part 33 is a button for switching ON/OFF of the power of the chair type massage machine 1. In the ON state, inputs of the massage course button 45*c* and the individual massage buttons 45*j* are received. Even in the OFF state, an input of the reclining buttons 45*d* can be received. The quick stop button 45*b* in the operation part 33 is a button for forcibly stopping operations of the chair type massage machine 1. By operating the quick stop button 45*b*, the chair type massage machine 1 stops treatment operations and the reclining operation.

The plurality of massage course buttons 45*c* in the operation part 33 are provided, and various courses such as a whole body massage course for massaging a whole body, a rubbing massage course which mainly includes a rubbing operation, a waist and stomach massage course which focuses on massage of a waist and a stomach, a stretch course for the purpose of stretching a body such as muscles of a back, and a pelvis course for tightening pelvises are prepared.

By the reclining button 45*d* in the operation part 33, it is possible to change an angle of the chair main body 11 and change the angle of the chair main body 11 to obtain a posture that the person to be treated desires. The rocking button 45*e* in the operation part 33 is for rocking the chair main body 11 and can cause the chair main body 11 to successively swing in the front-back direction. The shoulder position adjusting buttons 45*f* in the operation part 33 are for changing the position of the first massage part 6 and are used for changing shoulder positions detected by the first massage part 6.

The position change buttons 45*g* for the first massage part 6 in the operation part 33 are buttons for changing the position of the first massage part 6 and can move the first massage part 6 to a position that the user desires. The position change buttons 45*h* for the second massage part 7 in the operation part 33 are buttons for changing the position of the second massage part 7 and can move the second massage part 7 to a position that the user desires. The individual massage buttons 45*j* for individually massaging the respective parts to be treated in the operation part 33 are buttons which drive the third massage part 8, the fourth massage part 9, and the fifth massage part 10, which are air massage parts, respectively.

In addition, the operation part 33 includes light emitting parts 46 provided therein, and it is possible to recognize light from the light emitting parts 46 through a light transmission parts 47 provided in the operation part 33. For example, two light emitting parts are provided in the vicinity of the power button 45*a* to visually recognize the ON state and the OFF state, and the light emitting parts emit green light in the ON state and emit orange light in the OFF state. In addition, the massage course buttons 45*c* are configured such that a light emitting part 46 provided at a position corresponding to a massage course buttons 45*c* of a course being currently performed is turned on during the course in order to show the course being currently performed, and the reclining button 45*d* and the position change buttons 45*g* and 45*h* are configured such that the light emitting parts 46 thereof are turned on while the reclining button 45*d* and the position change buttons 45*g* and 45*h* are pressed.

As shown in FIG. 22A, a figure which represents the massage machine may be printed on the operation part 33. In the printed massage machine, the plurality of light transmission parts 47 are provided. The plurality of light transmission parts 47 are arranged in shapes of the first guide rails 151, and current positions of the first massage part 6 and the second massage part 7 are turned on.

As described above, the current positions of the first massage part 6 and the second massage part 7 can be recognized. The lighting position moves as the first massage part 6 moves, and the current position of the first massage part 6 can be visually recognized. In addition, the lighting position also moves in the case of the second massage part 7 in the same manner, and the current position of the second massage part 7 can be visually recognized. In addition, the positions of the first massage part 6 and the second massage part 7 are shown by the light emitting parts 46 with different colors in order to make it possible to discriminate the first massage part 6 from the second massage part 7. In addition, since the seat part 3 of the massage machine is a portion where the first massage part 6 and the second massage part 7 share the first guide rails 151, two light emitting parts may be turned on.

In addition, there is a human-shaped printing, which represents a human body, in the operation part 33 shown in FIG. 22B, and a plurality of light transmission parts 47 are provided in the human shape. The plurality of light transmission parts 47 are provided along trigger points in the longitudinal direction of the human body, and a light transmission part at a location being currently treated is turned on. In addition, the positions of the first massage part 6 and the second massage part 7 can be recognized. The lighting position moves as the first massage part 6 moves, and the current position of the first massage part 6 can be visually recognized.

In addition, the lighting position moves as the second massage part 7 moves in the same manner, and the current position of the second massage part 7 can be visually recognized. Moreover, since the current position of the first massage part 6 is also turned on while positions of shoulders are detected, the positions of the shoulders of the treated person are shown. Therefore, it is possible to visually recognize the positions of the shoulders of the person to be treated.

The control part 31 can perform massage by utilizing the advancing and retreating mechanism 90 of the first massage part 6. FIGS. 23, 24, 25, and 26 are diagrams in which massage is performed by utilizing the advancing and retreating mechanism 90 of the first massage part 6.

Figure 23A:
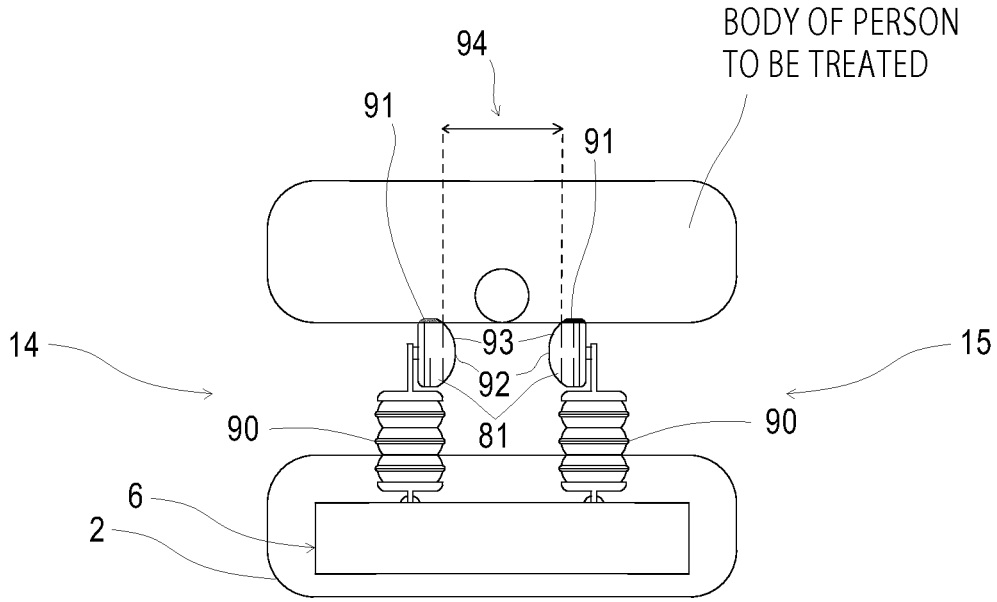
FIG. 23A is a diagram showing an example of a first massage part according to the embodiment of the present invention, specifically a state where the right and left treatment elements 81 are made to advance.
Figure 23B:
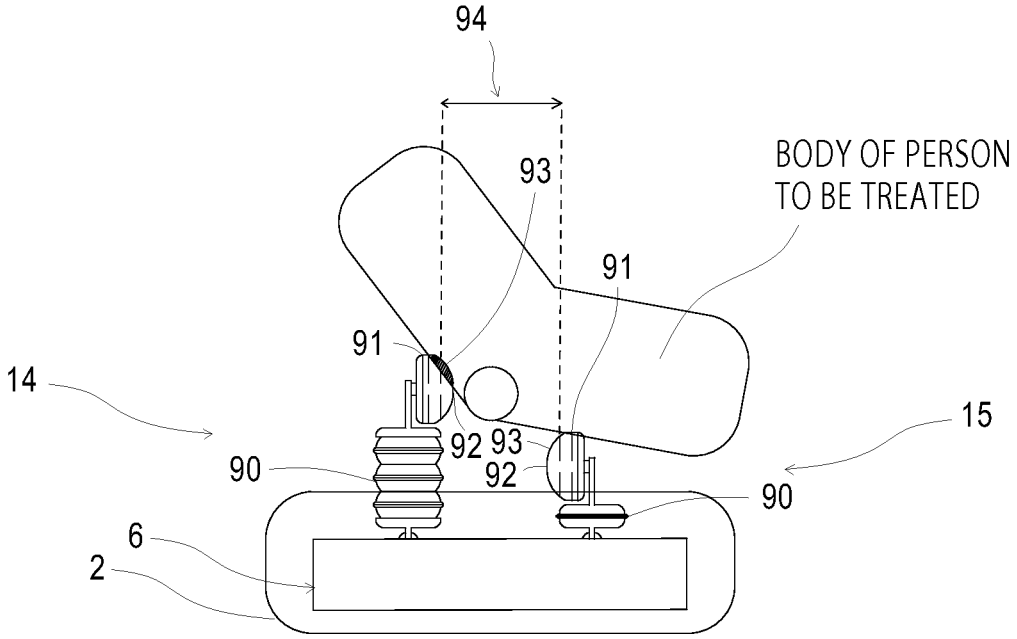
FIG. 23B is a diagram showing an example of a first massage part according to the embodiment of the present invention, specifically a state where the left treatment element is made to advance.

FIG. 23 is a diagram showing an operation example of a first massage part according to the embodiment of the present invention. FIG. 23A is a diagram showing a state where the right and left treatment elements 81 are made to advance. FIG. 23B is a diagram showing a state where the left treatment element 81 is made to advance.

Figure 24C:
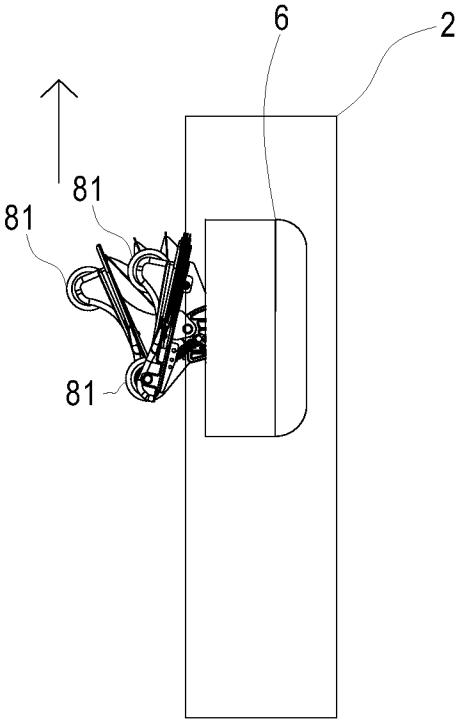
FIGS. 24A, 24B, and 24C collectively show a diagram with an operation example of the first massage part according to the embodiment of the present invention.
Figure 24B:
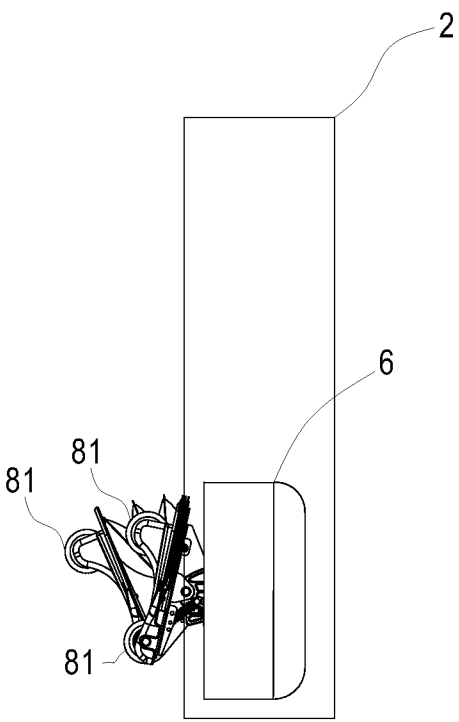
Figure 24A:
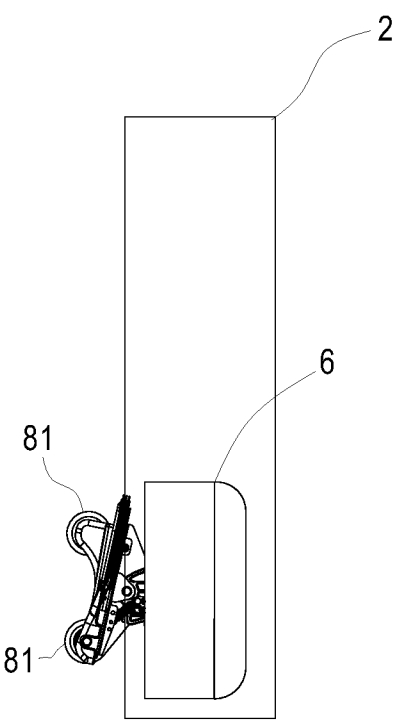
Figure 25A:
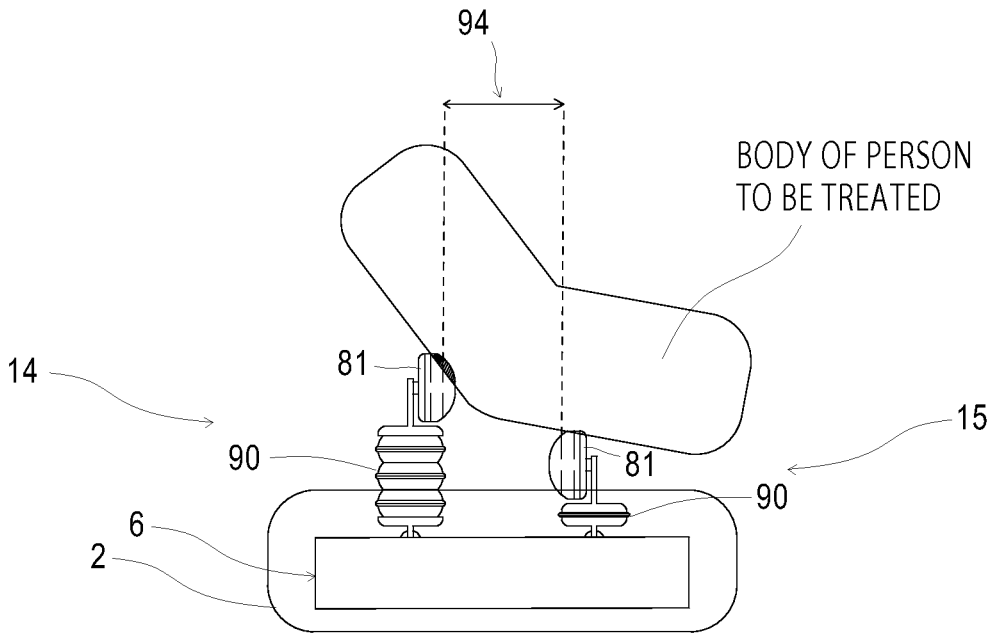
FIG. 25A is a diagram showing an operation example of the first massage part according to the embodiment of the present invention.
Figure 25B:
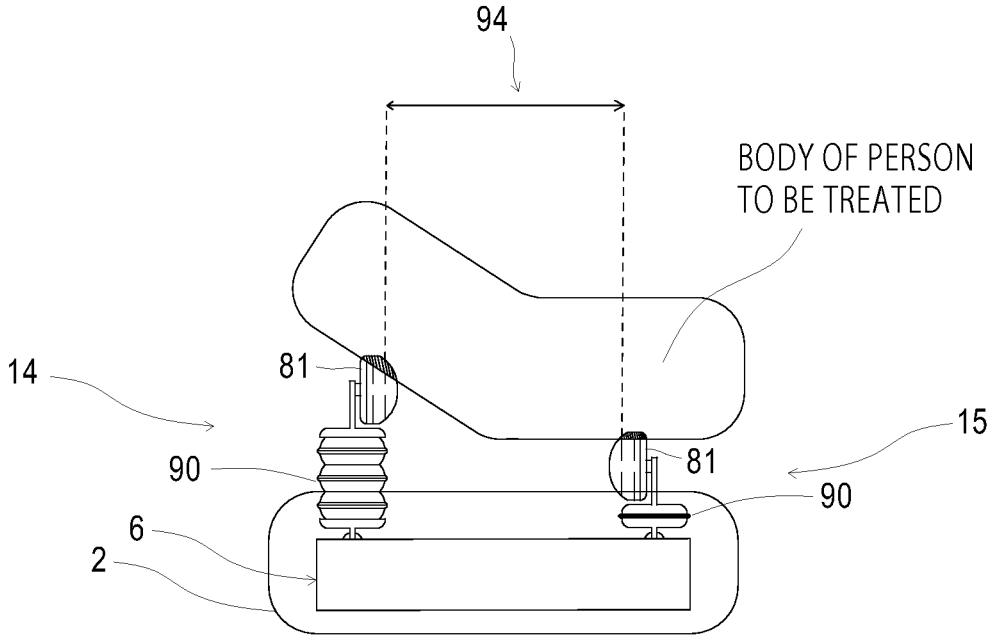
FIG. 25B is a diagram showing an operation example of the first massage part according to the embodiment of the present invention.
Figure 26:
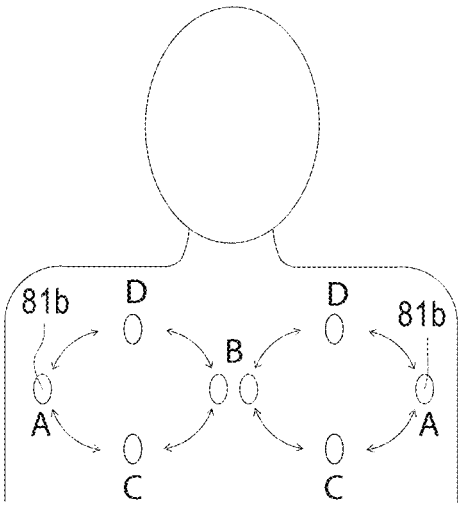
FIG. 26 is a diagram showing an operation example of the first massage part according to the embodiment of the present invention.

FIG. 24 is a diagram showing an operation example of the first massage part according to the embodiment of the present invention. FIG. 24A is a diagram showing a state where the first massage part 6 is positioned in the vicinity of the hip part. FIG. 24B is a diagram showing a state where the first massage part 6 causes the right treatment element 81 to advance. FIG. 24C is a diagram showing a state where the first massage part 6 causes the right treatment element 81 to advance and rises from the hip part to the vicinities of the shoulders. FIGS. 25A and 25B are diagrams in which the right treatment element 81 in an advancing state and the right treatment element 81 in a non-advancing state are made to move in the width direction by the width changing mechanism 69. FIG. 26 is a diagram showing a locus of the treatment elements 81 which are moved by the width changing mechanism 69.

As shown in FIGS. 23 and 24, the control part 31 can control the advancing and retreating mechanism 90 of the left massage unit 14 and the advancing and retreating mechanism 90 of the right massage unit 15 in the first massage part 6 and causes one of the treatment elements 81 of the right and left massage units 14 and 15 to perform massage in the advancing state. Since the massage is performed in such a state, the body of the person to be treated is inclined by the projecting treatment elements 81. Since the person to be treated is in the inclined state, a manner in which the person to be treated is in contact with the treatment elements 81 is changed. When the treatment elements 81 are not made to advance, or the advancing amounts are the same, the person to be treated is in contact with the treatment elements 81 in a state where only an outer extending portions 91 of the treatment elements 81 are in contact with the person to be treated as shown in FIG. 23A. When one of the treatment elements 81 is made to advance, the person to be treated is in contact with the treatment elements 81 in a state where an outer edge portion 91 of the treatment element 81 and an intermediate portion 93 between a center 92 and the outer edge portion 91 of the other treatment element 81 are in contact with the person to be treated as shown in FIG. 23B.

In addition, the left treatment element 81 and the right treatment element 81 are arranged with a predetermined interval 94, and the predetermined interval 94 between the left treatment element 81 and the right treatment element 81 corresponds to a region where the treatment elements 81 cannot be in contact and perform treatment when the treatment elements 81 are not made to advance or the advancing amounts are the same. However, since the outer edge portion 91 and the intermediate portion 93 of the treatment element 81 which has advanced are in contact with the body by causing the treatment element 81 to advance and bringing the person to be treated into the inclined state, the treatment elements reaches the region of the predetermined interval 94 where the treatment cannot be performed, and treatment can be performed on locations which cannot be treated in the related art. In addition, backbone is positioned in the predetermined interval 94, and muscles at the edges of the backbone can be massaged.

Moreover, the control part 31 can cause the first massage part 6 to perform massage while the first massage part 6 is made to move in the longitudinal direction of the body in a state where one of the treatment elements 81 of the left massage unit 14 and the right massage unit 15 is made to advance.

In FIG. 24B, the treatment element 81 of the right massage unit 14 is made to advance. As shown in FIG. 24*c*, the body can be stretched while being twisted by moving the first massage part 6 in the longitudinal direction of the body in a state where one of the treatment elements 81 is made to advance. When such an operation is performed, the control part 31 causes the advancing and retreating mechanism 90 to perform a massage operation by a first step of causing one of the right and left treatment elements 81 to advance, a second step of maintaining the state where the treatment element 81 has advanced, and a third step of moving the treatment element 81 in the longitudinal direction of the body.

Since one of the right and left treatment elements 81 advances by the first step, the person to be treated is brought into the inclined state. Since the state where the treatment element 81 has advanced is maintained by the second step, the state where the person to be treated is inclined is maintained. Since the treatment element 81 moves in the longitudinal direction of the person to be treated by the third step, the body of the person to be treated is stretched while being twisted. By such operations, the body of the person to be treated can be stretched while being twisted. In addition, the control part 31 controls the first elevation mechanism 65 of the first massage part 6 and operates the first massage part 6 along the first guide rails 151 and the second guide rails 171. In addition, the elevating operation may be a moving operation from the hip part toward the head part or a moving operation from the head part to the hip part, and the operation of stretching the body of the person to be treated while twisting the body is performed since the elevating operation is performed in a state where one of the treatment elements 81 projects.

In addition, the control part 31 can control the width changing mechanism 69 included in the first massage part 6. The width changing mechanism 69 (see FIG. 6) is configured of the drive source 62 for performing the kneading operation, the deceleration mechanism (not shown) which decelerates drive force from the drive source 62, the kneading shaft 71 which is coupled to the deceleration mechanism (not shown) and performs the kneading operation, and the variation angle part (not shown) which is bent at a predetermined angle in the middle of the kneading shaft 71.

As shown in FIG. 26, the width changing mechanism 69 can change the predetermined interval 94 between the right and left treatment elements 81 and can cause the treatment elements 81 to simultaneously perform the kneading operation. It is possible to perform massage in accordance with the widths of the body parts of the person to be treated by driving the width changing mechanism 69. For example, it is possible to expand the interval between the right and left treatment elements 81 for the shoulder parts and narrow the interval between the right and left treatment elements 81 for the lower back part. In addition, it is also possible to narrow or expand the interval between the right and left treatment elements 81 regardless of the size of the body part to be treated. It is possible to perform appropriate massage by changing the width of the treatment elements 81 in accordance with the body parts by the width changing mechanism 69 as described above.

In addition, it is possible to perform the kneading operation by continuously driving the width changing mechanism 69, in the kneading operation, the treatment elements are operated so as to depict an ellipse locus in the width direction of the back part of the person to be treated, and further, the ellipse locus depicts an ellipse locus so as to reciprocate in the front-back direction in the thickness direction of the person to be treated. That is, the operation in the right-left width direction and an operation like shiatsu are performed in combination during the kneading operation, and the person to be treated is treated by the kneading operation while being slightly swung in the front-back direction. It is possible to perform the treatment while changing the degree of inclination of the person to be treated by the combination of such a kneading operation and the advancing operations of the treatment elements 81, and if the movement in the longitudinal direction of the body is further applied, then it is possible to cause the person to be treated to swing by the kneading operation while the person to be treated is maintained in the inclined state, move the treatment elements 81 in the longitudinal direction of the body, and twist and stretch the body while the inclined state of the person to be treated is changed. In addition, since the kneading operation is performed while the treatment element 81 is made to advance, it is possible to perform the kneading massage in a shiatsu state and strengthen physical feeling of the kneading massage.

In addition, the control part 31 can control the width changing mechanism 69 (kneading operation) and set a drive range. As shown in FIG. 26, it is possible to realize shiatsu of twisting the location to be treated by performing shiatsu on the location to be treated based on the advancing operations of the treatment elements 81 and setting of the drive range of the width changing mechanism 69 and by changing the width, for which the drive range has been set, from the shiatsu state. The control part 31 causes the advancing and retreating mechanism 90 to perform a massage operation by a first step of causing one of the right and left treatment elements 81 to advance, a second step of maintaining the state where the treatment element 81 has advanced, a third step of causing the treatment elements 81 to approach by the width changing mechanism 69 after the second step, and a fourth step of maintaining the approaching state of the treatment elements 81 after the third step. In addition, the control part 31 controls the drive range of the width changing mechanism 69 and can precisely set the width of the treatment elements 81.

FIG. 26 shows an operation of the treatment elements 81 performing kneading massage (width change), and the treatment elements 81 performs the operation by depicting an ellipse movement locus. A position A, a position B, a position C, and a position D are shown as examples on the movement locus. A case where the pair of right and left treatment elements 81 are at the position A corresponds to a wide width, a case where the pair of right and left treatment elements 81 are at the position B corresponds to a narrow width, and cases where the right and left treatment elements 81 are at the position C and the position D correspond to an intermediate width. In addition, the treatment elements 81 at the position A are in a state of being located at the furthest positions from the backbone of the person to be treated, the position B is a position at which the treatment elements 81 are in the state of being located at the closest position to the backbone of the person to be treated, the position C is an intermediate position between the position A and the position B, which is in a state of being located at the furthest position from the position D which will be described later, and the position D is a position between the position A and the position B, which is in a state of being located at the furthest position from the position C.

In a case of performing the twisting shiatsu, it is necessary to drive the width changing mechanism 69 from the position C or the position D toward the position B. The operation of driving the width changing mechanism 69 from the position C or the position D toward the position B corresponds to the operation in the third step. In addition, since the third step is performed after the second step of causing the treatment elements 81 to advance, the state where the treatment elements 81 are in contact with the person to be treated and the person to be treated are pressurized is maintained, and it is possible to perform shiatsu of twisting and pressing the treatment elements 81 toward the part to be treated of the person to be treated if the width changing mechanism 69 is driven from the position C or the position D toward the position B in this state. Furthermore, since the width changing mechanism is driven to maintain the twisting state, it is possible to physically feel stronger shiatsu. In addition, since the person to be treated is in the inclined state, the outer edge portion 91 and the intermediate portion 93 of the treatment element 81 are in contact, and the treatment elements 81 are made to operate on the side of the backbone while the contact state is maintained. Accordingly, the operation becomes an operation of twisting muscles in the vicinity of the backbone in the operational direction of the treatment elements 81, and a twisting operation can be performed.

In addition, the control part 31 can perform an operation of causing one of the treatment elements 81 of the right and left massage units 14 and 15 to retreat from the state where the treatment elements 81 of the right and left massage units 14 and 15 are made to advance as shown in FIGS. 23A and 23B. It is possible to incline the body of the person to be treated by performing the operation of causing the treatment element 81 of one massage unit to retreat from the state where the treatment elements 81 of the right and left massage units 14 and 15 are made to advance, and the treatment elements 81 further bite into the body, which brings about an increase in feeling of the treatment. Thereafter, it is possible to perform the aforementioned massage operations.

In addition, the control part 31 can perform massage by differentiating the advancing amount of the left treatment element 81 from the advancing amount of the right treatment element 81 by controlling the advancing and retreating mechanism 90 of the left massage unit 14 to cause the left treatment element 81 to advance to the side of the person to be treated and controlling the advancing and retreating mechanism 90 of the right massage unit 15 to cause the right treatment element 81 to advance to the side of the person to be treated, as shown in FIG. 28. FIG. 28 shows the advancing amounts of the left treatment element 81 and the right treatment element 81 at detecting positions A to G, and treatment is performed with different advancing amounts on the right and left sides. Since degrees of stiffness in a left half body and a right half body of the treated person are different and there is a case where treatment of massaging the body by the treatment elements with the same advancing amounts is not appropriate, it is possible to perform massage in accordance with stiffness in the left half body and the right half body by performing the massage by the right and left treatment elements with different advancing amounts.

The first massage part 6 drives the advancing and retreating mechanism 90 of the left massage unit 14 and the advancing and retreating mechanism 90 of the right massage unit 15 and causes the treatment elements 81 to advance at a location to be treated. Since the advancing and retreating mechanisms 90 are formed of air cells, the swelling air cells 301 are deformed due to the weight of the person to be treated. In addition, when the locations to be treated of the person to be treated have gotten stiff, hardness of the locations to be treated differs on the right and left sides. Therefore, degrees of deformation of the swelling air cells 301 differ on the right and left sides, and the advancing amounts of the right and left treatment elements 81 differ depending on the degrees of the deformation. The deformation of the air cell 301 increases if the location to be treated is harder, and the deformation of the air cell 301 decreases if the location to be treated is softer. Furthermore, since the air cells 301 are provided with pressure sensors (not shown), valve bodies (not shown) for discharging a predetermined amount of air to the outside are provided in order to release the air inside the air cells 301 when excessive load is applied to the air cells 301. The advancing amounts of the right and left treatment elements 81 are also changed by the actions of the valve bodies (not shown). As described above, it is possible to perform massage by adjusting the advancing amounts of the right and left treatment elements 81 in accordance with the degrees of stiffness in the left half body and the right half body.

Figure 27A:
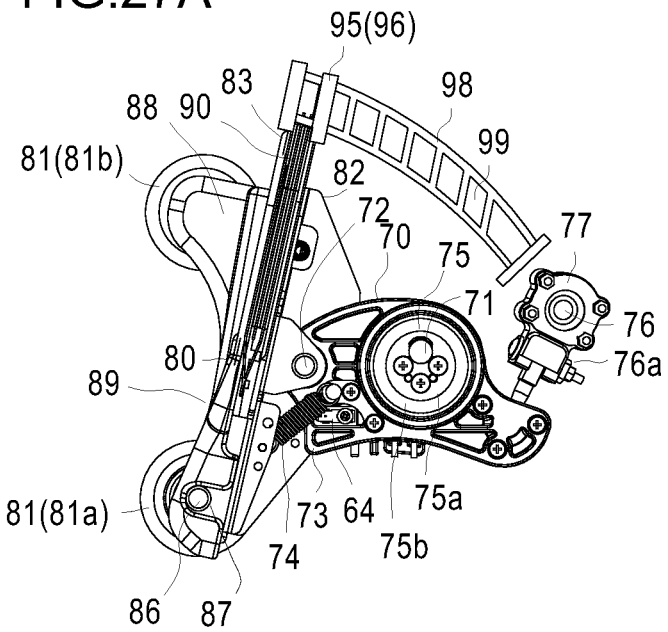
FIG. 27A is a diagram showing a detection part detecting an advancing amount of the first massage part, according to the embodiment of the present invention.
Figure 27C:
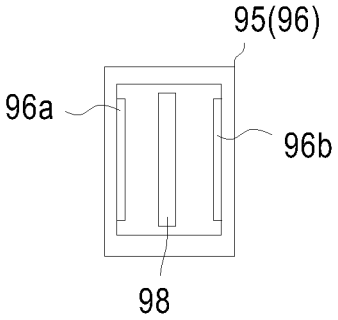
FIG. 27C is a diagram showing a detection part detecting an advancing amount of the first massage part, according to the embodiment of the present invention.
Figure 27B:
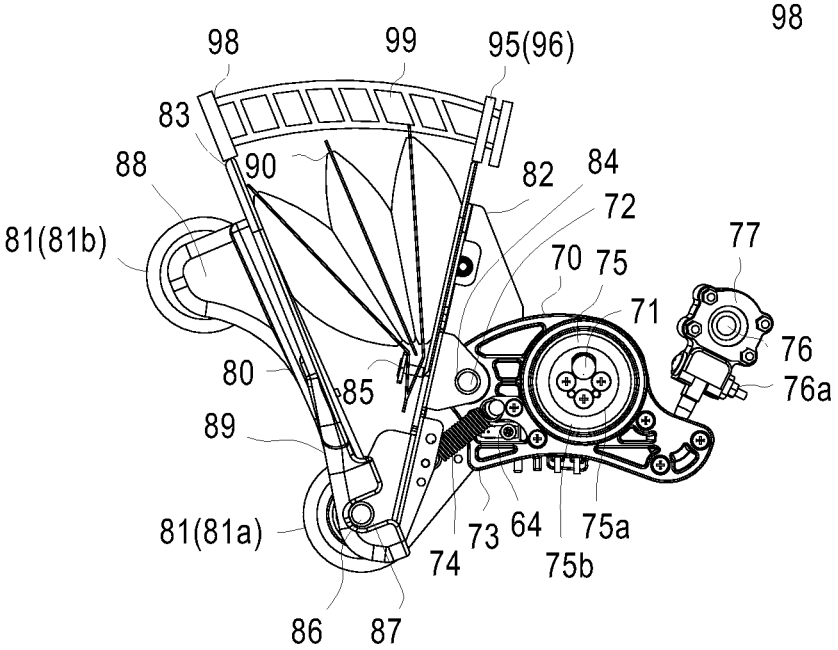
FIG. 27B is a diagram showing a detection part detecting an advancing amount of the first massage part, according to the embodiment of the present invention.

In addition, FIG. 27, namely, FIGS. 27A, 27B and 27C show a detection part 95 which detects the advancing amount of the left treatment element 81 and the advancing amount of the right treatment element 81. The advancing amount of the left treatment element 81 and the advancing amount of the right treatment element 81 are detected by the detection part 95. The left massage unit 14 includes a left detection part 96 which detects the advancing amount of the left treatment element 81 which has advanced to the side of the person to be treated by the advancing and retreating mechanism 90, and the right massage unit 15 includes a right detection part 97 which detects the advancing amount of the right treatment element 81 which has advanced to the side of the person to be treated by the advancing and retreating mechanism 90. Since the left detection part 96 and the right detection part 97 have the same configuration, a description will be given of an example of the left detection part 96.

The left detection part 96 is provided at the first treatment element support body 82 of the second arm 80, and the detected part 98 is provided at the second treatment element support body 83 The left detection part 96 is an optical sensor. The left detection part 96 includes a light receiving part 96*a* and a light emitting part 96*b*. The left detection part 96 is configured such that the light receiving part 96*a* and the light emitting part 96*b* are installed so as to face each other and a square plate with a plurality of holes 99, which is the detected part 98, moves between the light receiving part 96*a* and the light emitting part 96*b*. The detected part 98 includes locations at which light from the light emitting part 96*b* is blocked and holes 99 through which the light from the light emitting part 96*b* reaches the light receiving part 96*a* provided at a predetermined interval, and it is possible to know the advancing amount of the left treatment element 81 and the advancing amount of the right treatment element 81 by detecting the number of the holes 99.

Furthermore, the control parts 31 can compare the detected advancing amount of the left treatment element 81 and the advancing amount of the right treatment element 81 and set pressurizing force of the left treatment element 81 and pressurizing force of the right treatment element 81 based on the difference thereof as shown in FIG. 30. FIG. 30 is a diagram showing an advancing amount of the first massage part according to the embodiment of the present invention. In particular, FIG. 30A is a diagram showing the detected advancing amount of the left treatment element 81, the advancing amount of the right treatment element 81, and the difference thereof. FIG. 30B is a diagram showing pressurizing force set based on the difference. It is possible to know hardness of the left half body and the right half body and strain on the right and left sides of the person to be treated by supplying the same amount of air to the right and left ejecting air cells 301*a* and 301*b* and comparing the advancing amount of the left treatment element 81 and the advancing amount of the right treatment element 81 in a state of being in contact with the body of the person to be treated. Then, setting is made such that the amount of air to be supplied to the treatment element 81 of smaller advancing amount increases, and strong massage is performed on a stiffer half body. As described above, it is possible to pressurize the left half body and the right half body by the right and left treatment elements 81 with appropriate pressurizing force. In addition, a result of detecting the advancing amount of the left treatment element 81 and the advancing amount of the right treatment element 81 are stored on a storage part 48 (see FIG. 4).

In addition, the control part 31 can specify a body part to be treated of the person to be treated by utilizing the detected advancing amount of the left treatment element 81 and the advancing amount of the right treatment element 81 as shown in FIG. 29. In FIG. 29, irregularity in the back of the person to be treated is read from the advancing amounts of the right and left treatment elements 81, and the body parts are specified from conditions of the irregularity. The first massage part 6 moves upward from the hip part to the shoulders along the first guide rails 151. The advancing amount of the advancing and retreating mechanism 90 increases at a location which is greatly depressed, such as a lower back part, and the advancing amount of the advancing and retreating mechanism 90 decreases in the vicinity of the shoulder parts which project as compared with the lower back part, in the process in which the first massage part 6 rises. In addition, the advancing amount increases when the first massage part is positioned above the shoulders since no load is applied to the treatment elements 81. The body parts of the person to be treated are specified by detecting such conditions of irregularity.

In addition, the control part 31 can regard, as a location to be treated, a location at which the difference between the detected advancing amount of the left treatment element 81 and the advancing amount of the right treatment element 81 exceeds a predetermined value as shown in FIG. 31. The first massage part 6 supplies a predetermined amount of air to the air cell 301*a* and the air cell 301*b* of the advancing and retreating mechanisms 90, detects the advancing amounts of the right and left treatment elements 81, and causes the storage part 48 to store the advancing amounts of the right and left treatment elements 81. The stored advancing amounts of the right and left treatment elements 81 are compared, and a location at which the difference between the advancing amounts of the right and left treatment elements 81 exceeds the predetermined value is determined to be a stiff location. In addition, since the stiff portion is determined based on the difference between the advancing amounts of the right and left treatment elements 81, it is possible to perform treatment in accordance with an individual difference of the person to be treated. As described above, it is possible to specify a stiff body part and perform massage thereon.

As a method of specifying a stiff body part, the stiff body part is specified by bringing the advancing and retreating mechanisms 90 of the right and left massage units 14 and 15 into an advancing sate, elevating the first massage part 6, storing the advancing amounts of the right and left treatment elements 81 detected by the detection part 95 on the storage part 48, comparing the advancing amount of the left treatment element 81 and the advancing amount of the right treatment element 81, and causing the determination part 49 to determine a part at which the difference between the advancing amounts exceeds the predetermined value as a location to be treated. As described above, it is possible to specify a location to be treated.

According to the present invention, it is possible to provide a massage machine capable of simultaneously massaging different body parts in a height direction and thoroughly massaging body parts from a trunk part to a lower body. The preceding description is presented only to illustrate and describe exemplary embodiments of the massage machine according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A chair type massage machine comprising:

a chair main body, guide rails provided at the chair main body, a first massage part and a second massage part;

the chair main body comprises a seat part, a backrest part provided at a back part of the seat part, and a footrest which is provided at a front part of the seat part and supports leg parts of the person to be treated;

the first massage part and the second massage part are respectively movable in a height direction along the guide rails;

the guide rails comprise:

a first movement region provided so as to successively extend at least from a position corresponding to the backrest part to a position corresponding to the seat part via a curved part; and a second movement region which is provided so as to successively extent at least from a position corresponding to the footrest to the position corresponding to the seat part via a curved part, wherein the first massage part includes a first elevation mechanism that drives the first massage part being movable in the first movement region or from the first movement region to the second movement region; and wherein the second massage part includes a second elevation mechanism that drives the second massage part being movable in the second movement region or from the first movement region to the second movement region.

2. The chair type massage machine according to claim 1, wherein the first movement region in which the first massage part moves is a range of positions from the backrest part to a mid-way part of the seat part, and wherein the second movement region in which the second massage part moves is a range of positions from the footrest to the mid-way part of the seat part.

3. The chair type massage machine according to claim 1, wherein the guide rails comprise a collision preventing region, wherein the chair type massage machine includes collision preventing means for preventing the first massage part and the second massage part from colliding with each other in the collision preventing region.

4. The chair type massage machine according to claim 1, wherein the guide rails include a first limit sensor that detects a position corresponding to a lower limit of the first massage part and a second limit sensor that detects a position corresponding to an upper limit of the second massage part.

5. The chair type massage machine according to claim 4, further comprising:

a control part, wherein the control part stops movement of the second massage part or moves the second massage part in a direction away from the first massage part when the control part detects a signal for the position corresponding to the lower limit of the first massage part, and stops movement of the first massage part or moves the first massage part in a direction away from the second massage part when the control part detects a signal for the position corresponding to the upper limit of the second massage part.

6. The chair type massage machine according to claim 1, further comprising:

a base that supports the chair main body, wherein the chair main body swings relative to the base.

7. The chair type massage machine according to claim 1, wherein the first massage part and the second massage part have different structures, and wherein the first massage part has a structure which is at least suitable for massaging an upper body, and the second massage part has a structure which is at least suitable for massaging a lower body.

8. The chair type massage machine according to claim 7, wherein the first massage part includes a pair of treatment elements and is configured to be able to perform kneading massage on a trunk part of a person to be treated by causing the treatment elements to move close to and away from each other, and wherein the second massage part includes a pair of treatment parts and is configured to be able to massage outer surfaces of leg parts of the person to be treated with the treatment parts.

9. The chair type massage machine according to claim 1, further comprising:

a posture changing means, wherein the posture changing means includes a posture changing body and posture change affected bodies, wherein the posture changing body is provided at the chair main body, wherein the posture change affected bodies are provided at the first massage part and the second massage part, and wherein the posture changing means changes postures of the first massage part and the second massage part.

10. The chair type massage machine according to claim 8, wherein the first massage part includes a first mechanism for moving the pair of treatment elements to advance toward or retreat from the person to be treated, and wherein the second massage part includes a second mechanism for moving the pair of treatment parts to advance toward or retreat from the person to be treated.

* * * * *